United States Patent [19]

Ueno et al.

[11] Patent Number: 4,754,801

[45] Date of Patent: Jul. 5, 1988

[54] DIE CASTING METHOD AND APPARATUS THEREFOR

[75] Inventors: Toyoaki Ueno; Takeshi Mihara; Kouji Kawabata, all of Yamaguchi, Japan

[73] Assignee: UBE Industries, Ltd., Ube, Japan

[21] Appl. No.: 81,553

[22] Filed: Aug. 3, 1987

Related U.S. Application Data

[63] Continuation of Ser. No. 832,989, Feb. 24, 1986, abandoned.

[30] Foreign Application Priority Data

Feb. 25, 1985 [JP] Japan ..... 60-34610
Apr. 8, 1985 [JP] Japan ..... 60-72766

[51] Int. Cl.[4] ..... B22D 5/02; B22D 17/26

[52] U.S. Cl. ..... 164/154; 164/312; 164/325; 164/327; 164/342; 164/344; 164/348

[58] Field of Search ..... 164/113, 130, 137, 154, 164/312, 322–328, 339, 341–344, 348

[56] References Cited

U.S. PATENT DOCUMENTS 1,925,497 9/1933 Shippy ..... 164/327
3,866,666 2/1975 Wunder ..... 164/327
4,269,259 5/1981 Ueno et al. ..... 164/303
4,287,935 9/1981 Ueno et al. ..... 164/312
4,431,046 2/1984 Phillips ..... 164/326
4,506,722 3/1985 Yamaguchi et al. ..... 164/325

FOREIGN PATENT DOCUMENTS 46-19820 7/1971 Japan .
53-11971 4/1978 Japan .

*Primary Examiner*—Nicholas P. Godici
*Assistant Examiner*—Richard K. Seidel
*Attorney, Agent, or Firm*—Blakely, Sokoloff, Taylor & Zafaman

[57] ABSTRACT

A die casting machine in which a rotary table, mounted with a plurality of die open and close units each holding a die, is sequentially brought into association with a plurality of work stations. The die is clamped in two steps, that is, a regular die clamping and a temporary die clamping. The regular die clamping is carried out by applying the regular clamping force required by a particular injection step. The temporary die clamping is carried out by applying a clamping force which is smaller than the regular clamping force. Consequently, this die casting machine can greatly reduce the time required for the casting cycle for each product, thus providing remarkably improved productivity. Preferably, a metal cooling apparatus suitable for a rotary die casting machine may be further provided.

13 Claims, 26 Drawing Sheets

DIE CASTING METHOD AND APPARATUS THEREFOR

This is a continuation of application Ser. No. 832,989 filed Feb. 24, 1986, now abandoned.

BACKGROUND OF THE INVENTION

1. Field of the Invention

The present invention relates to a die casting method and an apparatus therefor.

2. Prior Art

Die casting machines are classified by vertical clamping and lateral clamping type in terms of the die clamping direction, and by vertical casting and lateral casting type in terms of the pouring direction of hot molten metal into a die.

A conventional vertical clamping, vertical casting type of die casting machine is shown in FIG. 27, in longitudinal section form, and is similar to that described, for example, in U.S. Pat. Nos. 4,269,259 and 4,287,935. This conventional die casting machine will be briefly described with reference to this figure. A cylinder platen 1 and a base platen 2 are joined to each other in a vertical direction by means of four tiebars 3. These tiebars 3 support a moving platen 6 vertically movable under the actuation of a main ram 4 and a pull-back cylinder 5. To both the platens 2 and 6, a stationary metal mold 7 and a movable metal mold 8 are respectively mounted to oppose each other. An injection cylinder generally denoted by reference numeral 9 is tiltably supported by means of a pin 12 on a platen 11 provided at the lower end of tiebars 10 suspending from the base platen 2. The injection cylinder has a cylinder 13, a piston rod 13 vertically movable within the cylinder 13 under the application of oil pressure, a plunger 16 joined to the piston rod 14 by means of a coupling 15, a block 18 supported, vertically movably, at the upper end of the cylinder 13, rams 19 studded on the upper surface of the cylinder 13 to vertically move the block 18 under the application of oil pressure, and an injection sleeve 20 mounted to the upper end of the block 18 to allow a head of the plunger 16 to be fitted in the injection sleeve 20. The entirety of the injection cylinder 9 can be tilted from a position indicated by a solid line to a position indicated by a phantom line by operating a tilting cylinder 21 and a swingable link 21*a*. Additionally provided for a conventional die casting machine, but not shown, are a device for feeding hot molten metal, a device for taking out products and a spraying device.

A casting operation with the die casting machine thus configured will now be described. The moving platen 6 to which the movable metal mold 8 is secured is first lowered by the actuation of the main ram 4 to press the movable metal mold 8 against the stationary metal mold 7, thus completing die clamping. Subsequently the injection cylinder 9 is tilted by the actuation of the tilting cylinder 21 to the position indicated by a phantom line and hot molten metal is poured into the injection sleeve 20 by using the device for feeding hot molten metal. Thereafter, the injection cylinder 9 is returned to the position indicated by a solid line so as to be held uprightly and the block 18 is elevated by using the ram 19, thus fitting the injection sleeve 20 into a stationary sleeve 22 formed in the metal mold 7. Then, by actuating the injection cylinder 9 to elevate the plunger 16 within the injection sleeve 20, hot molten metal is injected into a cavity defined by the metal molds 7 and 8. After the hot molten metal is solidified and cooled subsequent to the completion of the injection, the moving platen 6 is raised by using the pull-back cylinder 5 to open the die, and thereafter the solidified product is taken out to the outside of the machine with the product take-out device. Finally, the cavity is cleaned and applied with a mold release by using the spraying device, thereby completing preparation for a next casting work. Thus, one casting cycle is completed.

However, the conventional die casting carried out with an apparatus constructed as above requires a good deal of time for completing one die casting cycle, resulting in poor productivity. FIG. 28A shows the times required for the respective steps of the die casting cycle when using the above-mentioned conventional die casting machine. As seen from this figure, it takes about 45 seconds for solidifying and cooling the product after injection, and about 40 seconds for cooling, cleaning and spraying the die after take-out of the product. Accordingly, about 114 seconds are required for completing one cycle. Thus, 70% or more of the total time in using a conventional apparatus is consumed by the steps preparatory to the die casting itself (i.e., die clamping, injection and die opening). This results in substantial waiting time and corresponding poor productivity.

SUMMARY OF THE INVENTION

With the above in mind, an object of the present invention is to greatly reduce the time required for the casting and pouring cycle for each product, thus providing remarkably improved productivity.

Another object of the present invention is to provide a die open/close cylinder for virtual or temporary die clamping in addition to an eventual or regular die clamp cylinder in order to reduce the die clamping force needed after hot molten metal is solidified, thereby remarkably lessening the amount of energy used for die clamping.

To achieve these objects, according to the present invention, a plurality of stations are provided to carry out casting by rotating a table at least during the process of cooling the product and before the regular mold clamping is initiated. The apparatus for implementing this comprises a rotatable table on which a plurality of die open and close units held by a plurality of holders are removably mounted. Further, a die clamping device, an injection device, a product taking-out device and a die spraying device are arranged on the rotation path of the rotatable table in order to process the product at respective stations.

With the configuration stated above, the plurality of die open and close units are mounted on the rotatable table at the stations provided and positioned with the die clamping and injection devices so as to carry out their respective processes. As a product is cooling within a die open and close unit positioned at a die clamping and injection station, the rotatable table is rotated by an angle corresponding to one station interval. Since, during this rotation, die spraying and product take-out have been completed with respect to the remaining die open and close units positioned at the remaining stations, the metal molds and processes for taking out product at these remaining die open and close units are ready for the subsequent processes at the subsequent stations when arriving thereat. Such a rotational operation is intermittently conducted at a predetermined timing, thus making it possible to continuously carry out casting work.

A further object of the present invention is to provide a metal mold cooling device suitable for a rotary die casting machine. To achieve this object, according to the present invention, a plurality of die open and close units are mounted on a rotary table which intermittently rotates. A feed water conduit rotating along with the rotary table is also provided. A feed water source provided on a non-rotating part communicates with a feed water pipe which is inserted into an annular opening of the feed water conduit. The bottom of the feed water conduit and an entrance of cooling piping within the die are connected by circulating piping connected to a pump. On the non-rotating part, a drain conduit is provided. A drain pipe in communication with an exit of the cooling piping within the die is inserted into an annular opening of the drain conduit. Further, drainage means are connected to the drain conduit.

With the configuration stated above, when the rotary table is rotated and then stopped, necessary work is implemented to the die open and close units at the work stations located at stop positions of the rotary table. At this time, cooling water is fed from the feed water pipe inserted into the annular opening of the feed water conduit to the feed water conduit rotating along with the rotary table. This cooling water circulates within the die to cool it. Thereafter, the water is drained into the drain conduit of a stationary part through the drain pipe inserted into the annular opening thereof. Further, the water thus drained is discharged to the outside of the apparatus by means of drainage means.

BRIEF DESCRIPTION OF THE DRAWINGS

The features and advantages of a die casting method and apparatus according to the present invention will become more apparent from the following description taken in conjunction with the accompanying drawings, in which.

DETAILED DESCRIPTION OF THE INVENTION

Figure 2:
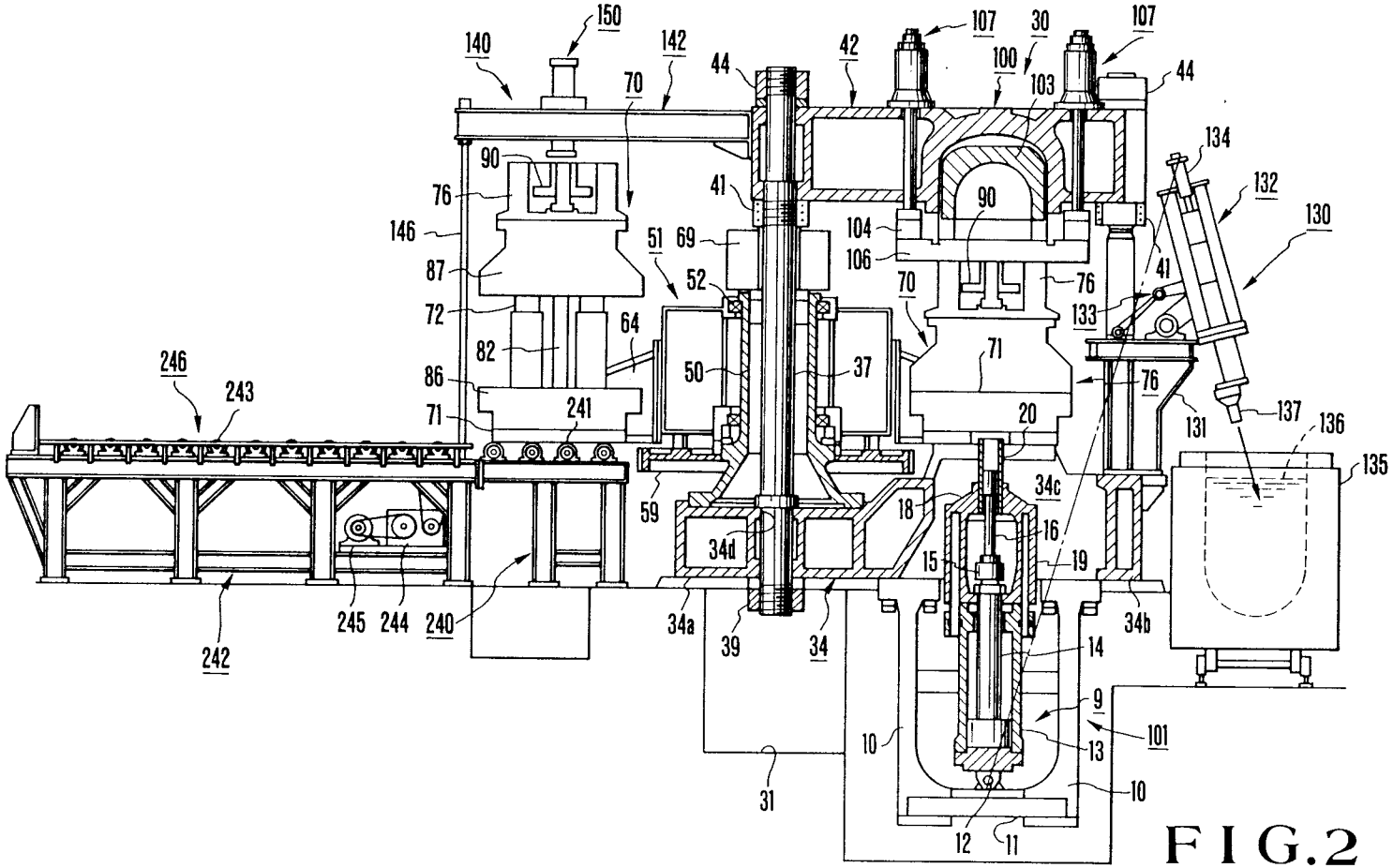
FIG. 2 is a sectional view taken along line A—A in FIG. 1.
Figure 3:
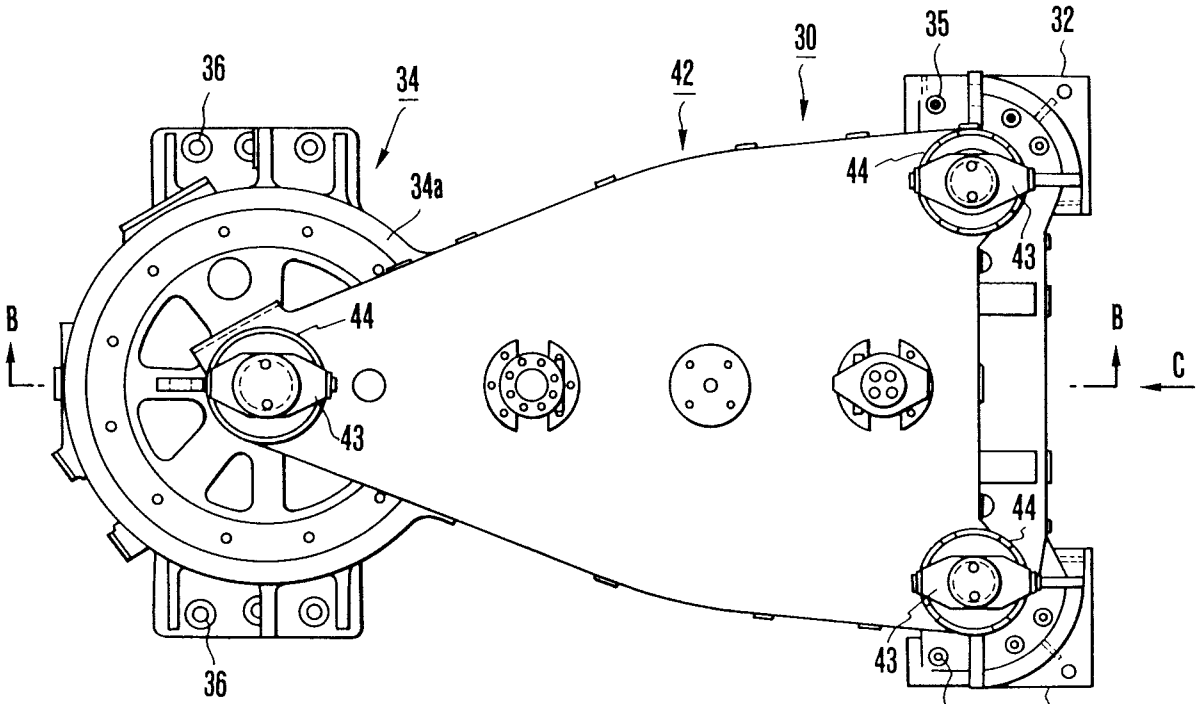
FIG. 3 is a plan view illustrating a first station employed in the apparatus according to the present invention.
Figure 4:
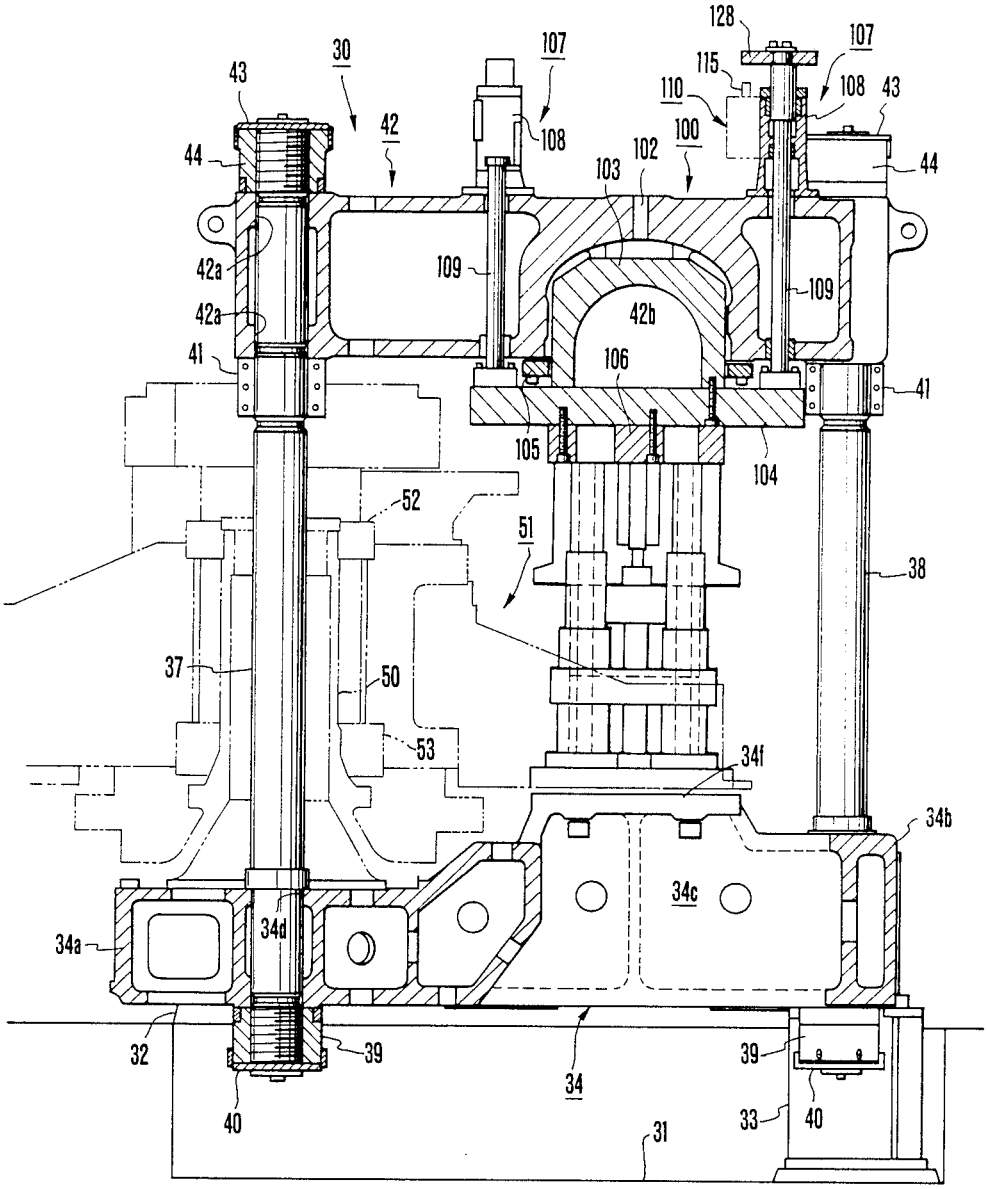
FIG. 4 is a sectional view taken along line B—B in FIG. 3.
Figure 5:
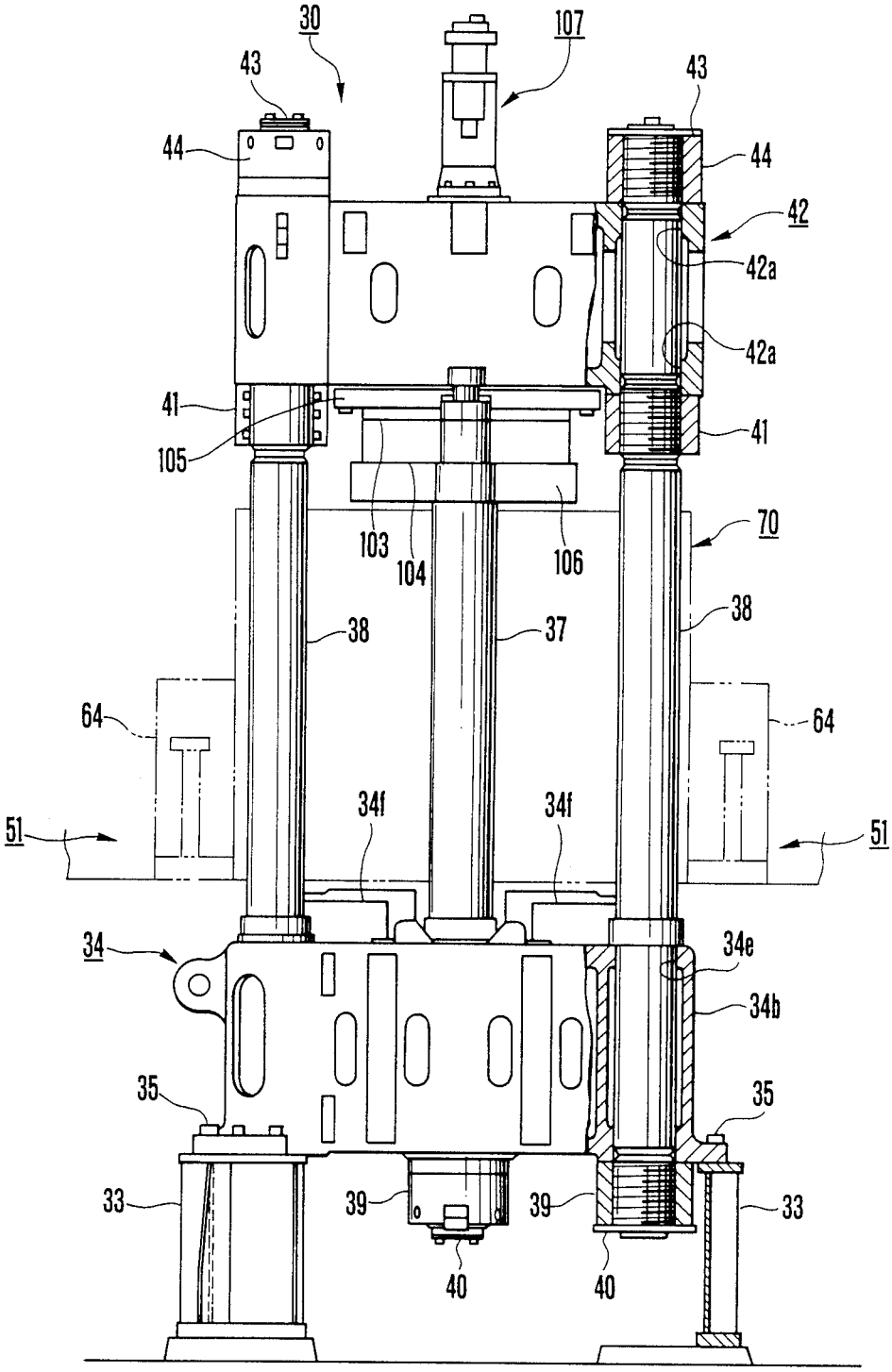
FIG. 5 is a side view as viewed in a direction of arrow C in FIG. 3.

A first station generally denoted by reference numeral 30 and illustrated in a plan view in FIGS. 1 and 3 will first be described. A base platen 34 (FIGS. 1 to 5) is fixedly mounted by means of anchor bolts 35 and 36 onto floor foundations 32 (FIGS. 3, 4 and 5), located at the front and rear of a pit 31 (FIGS. 2 and 4) below the floor, and a pair of front and rear bases 33 (FIGS. 4 and 5) fixed within the pit 31. This base platen 34 is integrally formed of a table supporting member 34*a*, an injection member 34*b* and a metal mold contact member 34*f* located at the front and rear of the injection member 34*b*, i.e., at the front and rear of a rotary table 51 (which will be described later). In plan form, the member 34*a* is circular and the member 34*b* is of an isosceles triangular-like configuration. The injection member 34*b* is formed with a hollow portion 34*c* into which an injection device 101 to be described later is placed.

Tiebar holes 34*d* and 34*e* are provided at the central portion of the table supporting member 34*a* and at both ends of the bottom side of the triangle of the injection unit 34*b*. Into these tiebar holes 34*d* and 34*e*, the lower ends of upright tiebars 37 and 38 are fitted. The downward movement of the tiebars is limited by a flange. Tiebar nuts 39 are screwed onto projection-threaded lower ends of the tiebars 37 and 38, thus securely fixing the tiebars 37 and 38. Turn-stop elements 40 are provided for preventing the tiebar nuts 39 from releasing. The tiebars 37 and 38 have, at the same level, threaded upper portions on which split nuts 41 are screwed, thus clamping and fixing the tiebars. The downward movement of a cylinder platen 42 of an isosceles triangular configuration is limited by the split nuts 41.

The upper ends of the tiebars 37 and 38 are fitted into tiebar holes 42*a* formed in a piece of the triangle. The tiebars 37 and 38 have projecting threaded upper ends on which tiebar nuts 44 are screwed. Each of the tiebar nuts 44 is provided with a turn-stop element 43 which is the same as that provided at the lower end, thus securely fixing the cylinder platen 42 between the tiebar nuts 44 and the split nuts 41.

The supporting structure for the first station has now been described. A die clamping device will be described subsequent to the following description of the rotary table and the die open and close unit.

Figure 6:
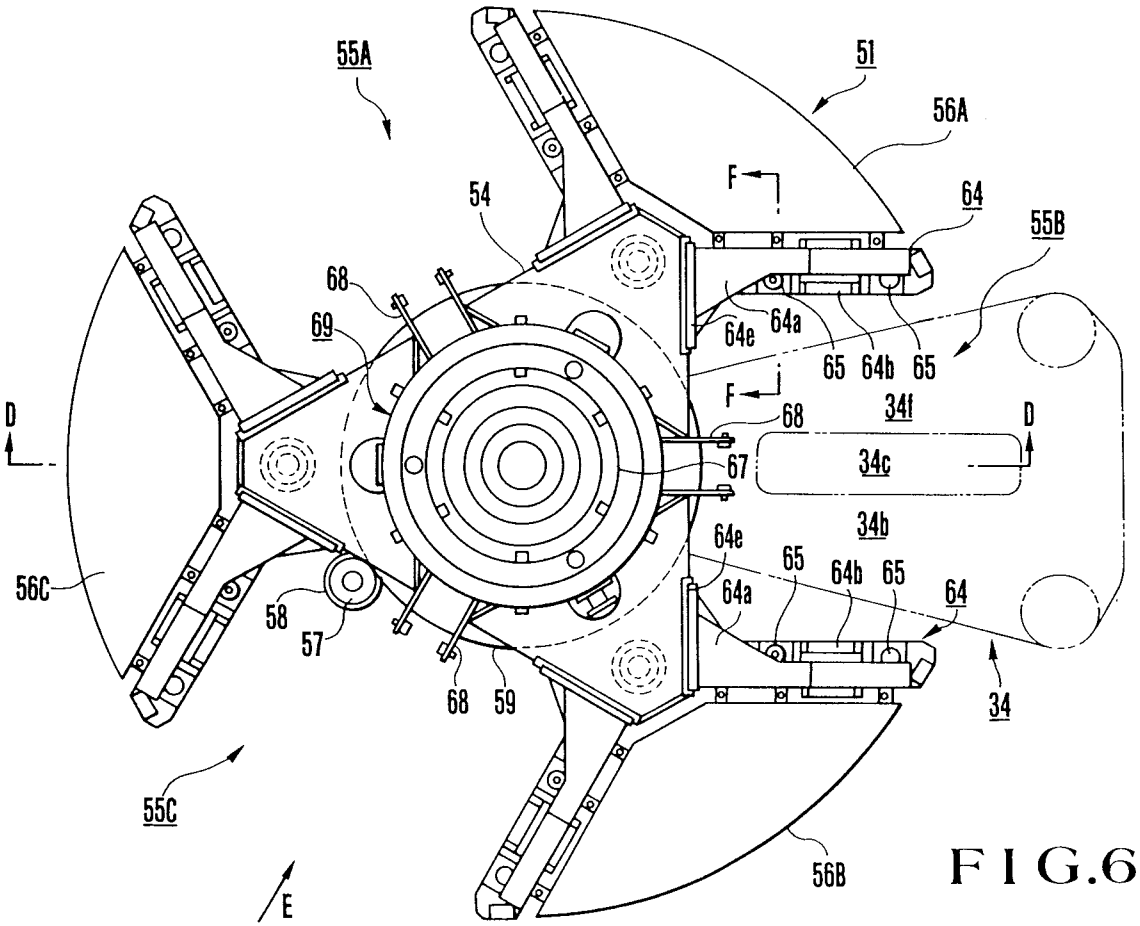
FIG. 6 is a plan view illustrating a rotary table employed in the apparatus according to the present invention.
Figure 7:
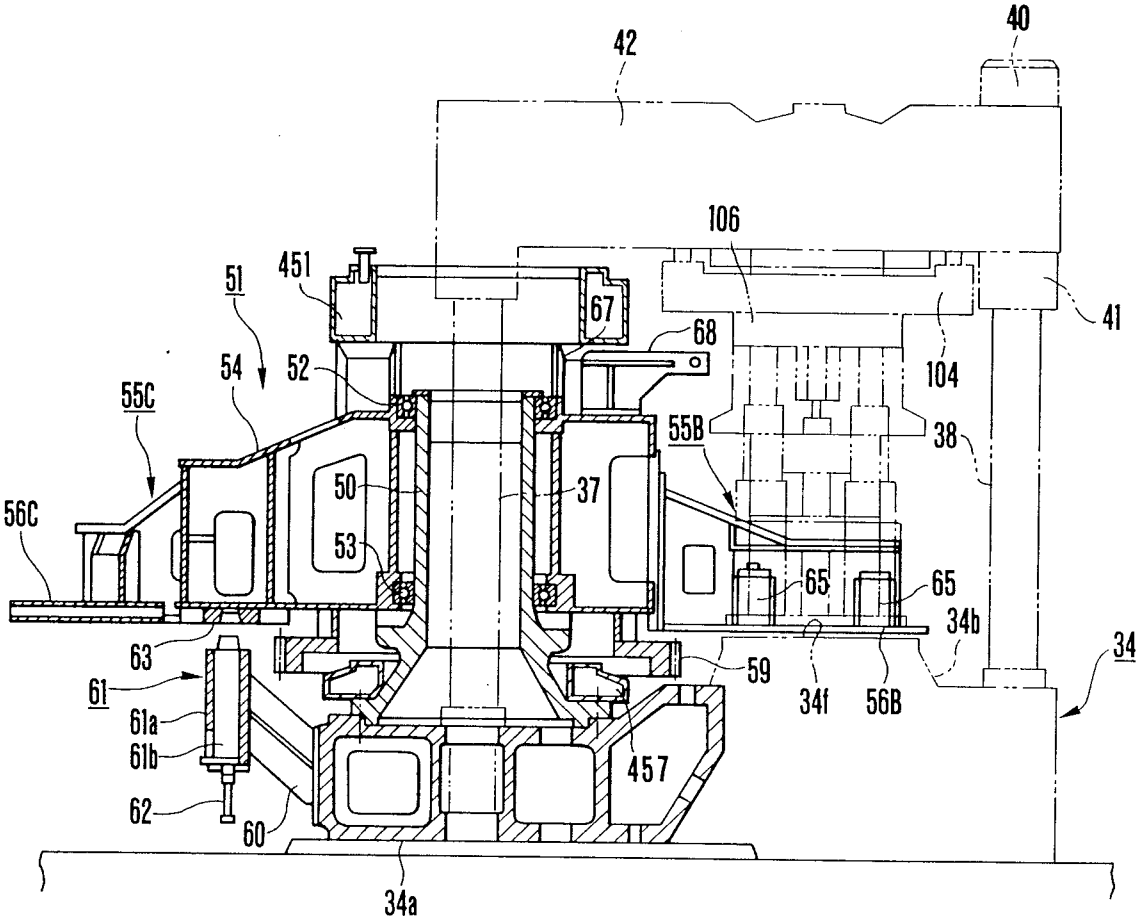
FIG. 7 is a sectional view taken along line D—D in FIG. 6.

On the upper surface of the table supporting member 34*a* of the base platen 34, an inverted funnel-shaped hollow shaft 50 for table rotation is fixed uprightly so as concentrically to surround the tiebar 37. The rotary table generally denoted by reference numeral 51 is rotatably supported by the hollow shaft 50 through upper and lower ball bearings 52 and 53. The major part of the rotary table 51 consists of a center frame 54 (FIGS. 6 and 7) having a regular triangular plan form and fitted on the ball bearings 52 and 53, three sets of die open and close unit holders or retainers 55*a*, 55*b* and 55*c* (which will be described later) arranged at positions opposing respective sides of the regular triangle, and sector-shaped supporting plates 56*a*, 56*b* and 56*c* supported between adjacent die open and close unit holders. A pinion 57 is directly coupled to motor 58 on the base plate 34. The pinion 57 meshes with a gear 59 fixed on the rotary table 51. When the motor 58 rotates in response to a command from a control unit (not shown), the rotary table 51 intermittently rotates at the rate of one-third of a revolution per a predetermined unit of time. A bracket 60 projects from the outer peripheral portion of the table supporting member 34*a*. A positioning cylinder 61 is vertically supported by the bracket 60 and comprises a cylinder 61*a* and a ram 61*b* for vertical advance and withdrawal. At the lower end of the cylinder 61, an oil pressure cylinder 62 for advancing and withdrawing the ram 61*b* is mounted. The center frame 54 has on its lower surface three positioning plates 63 located at the verticies of the triangle. Each plate 63 is formed with a bore adapted to be in engagement with the head of the ram 61*b* when the ram 61 advances. Each time the rotary table 51 rotates by one-third of a revolution and stops, each ram 61*b* rises for sequential engagement with the respective positioning plates 63, thus securely positioning the rotary table 51 at stop positions.

Figure 9:
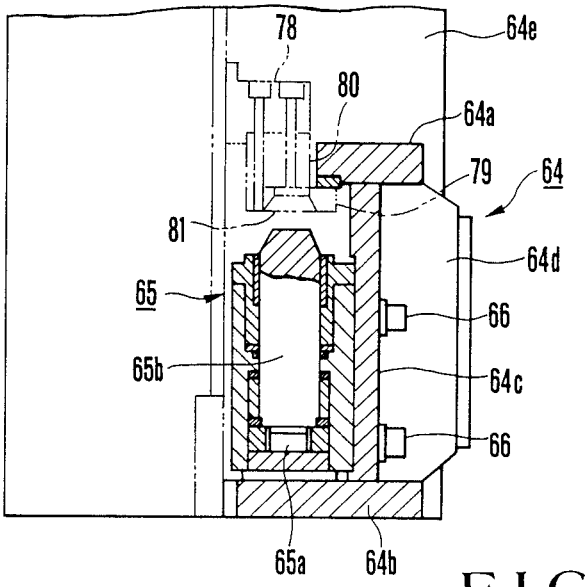
FIG. 9 is an enlarged sectional view taken along line F—F in FIG. 6.

The above-mentioned die open and close unit holders 55*a*, 55*b* and 55*c* are of the same structure. Therefore, by way of example, the die open and close unit holder 55B and a die open and close unit 70 which is held thereby will be described. A pair of arms 64 project from opposite ends on the vertical surface of the center frame 54. As shown in sectional form in FIG. 9, each arm 64 has an I-shaped section which is formed of upper and lower horizontal members 64*a* and 64*b* and a vertical member 64*c*, and is reinforced by a rib 64*d*. A rectangular base plate 64*e* of the arm is bolted to the vertical surface. At the front and rear of the left and right arms 64, a pair of push-up cylinders 65 are provided, respectively. The push-up cylinders 65 are supported by the lower horizontal member 64*b* and fixed by bolts 66. The push-up cylinders 65 are each provided with a ram 65*b* vertically movable upon the application of pressurized oil introduced into a port 65*a*. These push-up cylinders 65 support the die open and close unit 70 (to be described later) which abuts against the upper horizontal members 64*a* of the arms 64 when the rams 65*b* move upwards under the application of oil pressure. Stoppers 68 project from a cylindrical body 67 fixed on the center frame 65 until they reach above the middle portion of each arm 64, thus limiting the movement of the die open and close unit 70. Feed water chambers 451 and 457 for cooling the die are fixed on the cylindrical body 67 and on the leg of the hollow shaft 50.

The die open and close unit generally denoted by reference numeral 70 has at its lower end surface a fitting bed 71 of a rectangular plate. The fitting bed 71 is formed at the central portion thereof with a through hole 71*a* into which an injection sleeve and a piston rod 149*c* of a projection cylinder 149, which will be described later, are insertable. At four corners of the fitting bed 71, square tubular brackets 72 are vertically provided by bolting their base plates 73. Within the respective brackets 72, guide rods 75 are supported through bushes 74 so as to be movable vertically. Each guide rod 75 has a projecting upper end fitted in an axial bore of a top frame 76 (to be described later) so that the top frame can move vertically along with the guide rod 75. Side surfaces of adjacent brackets 72 of the die open and close unit 70 thus assembled are connected together by upper guide plates 77 and lower stays 78. A liner 79 is bolted to each stay 78 through a spacer 80.

The die open and close unit 70 is inserted between the pair of arms 64 until it comes in contact with the stoppers 68. Accordingly, a ram hole 81 formed in the liner 79 opposes the ram 65*b*. When the respective rams 65*b* are elevated as stated above, the die open and close unit 70 rises because the rams 65*b* are in engagement with the ram holes. At this time, the liners 7 come in contact with the horizontal members 64*a* of the arms 64, so as to limit the upward movement of the die open and close unit 70. As a result, the liner is pushed against the surface of the horizontal member 64*a* under the application of oil pressure, thus allowing the fitting bed 71 of the unit 70 to be spaced apart from the base platen 34. When the die open and close unit 70 is pushed down in opposition to oil pressure of the push-up cylinder 65 in accordance with a die clamping force to be described later, the lower surface of the fitting bed 71 of the die open and close unit 70 seats, at front and rear, on the upper surface of the metal mold contact member 34*f* of the base platen 34.

Between the pair of brackets 72, a die open and close cylinder 82 is provided uprightly. A cylinder block 84 screwed onto a threaded operating end of a piston rod 83 of the cylinder 82 is pivotable within a block 85 fixed to either end surface of the top frame 76. By advancing and withdrawing the piston rod 83 by making use of oil pressure, the top frame 76 is vertically moved with the guide rod 75 guided by the bush 74. A stationary metal mold 86 and a movable metal mold 87 which define a die cavity are detachably mounted by a fastening means to the fitting bed 71 and the top frame 76. By vertically moving the top frame 76, the molds can be opened or mated. A necessary minimum weak die clamping force (virtual or temporary) is maintained when mating the molds. A pair of rams 88 are bolted to the upper surface of a bottom 76*b* of a recess 76*a* provided in the top frame 76 so as to stand uprightly. At the central portion of the bottom 76*b*, a guide pusher shaft 89 is studded. These two rams 88 and the shaft 89 are slidably fitted in cylinders 90*a* and a boss 90*b*, respectively, which are integral with an ejector plate 90 and extend beyond the plate 90. The shaft 89 penetrates through boss 90*b* and slightly projects therefrom upwardly. Pushers 91 are bolted to the bottom 76*b* and guide vertical movement of the ejector plate 90 and provide an upper limit. Within the cylinder 90*a*, a pressurized oil is introduced to push up the ejector plate 90 to the upper limit. A product pusher device including the ejector plate 90 will be described later. Further, safety hooks 92 and 93 are provided. When the top frame 76 rises to the upper limit, thus allowing the die to be opened, these hooks 92 and 93 engage the brackets 72 below the guide rods 75 to limit downward movement of the top frame 76 and the movable metal mold 87. These hooks, an operating rod 94 and a link mechanism 95 are connected.

Figure 10:
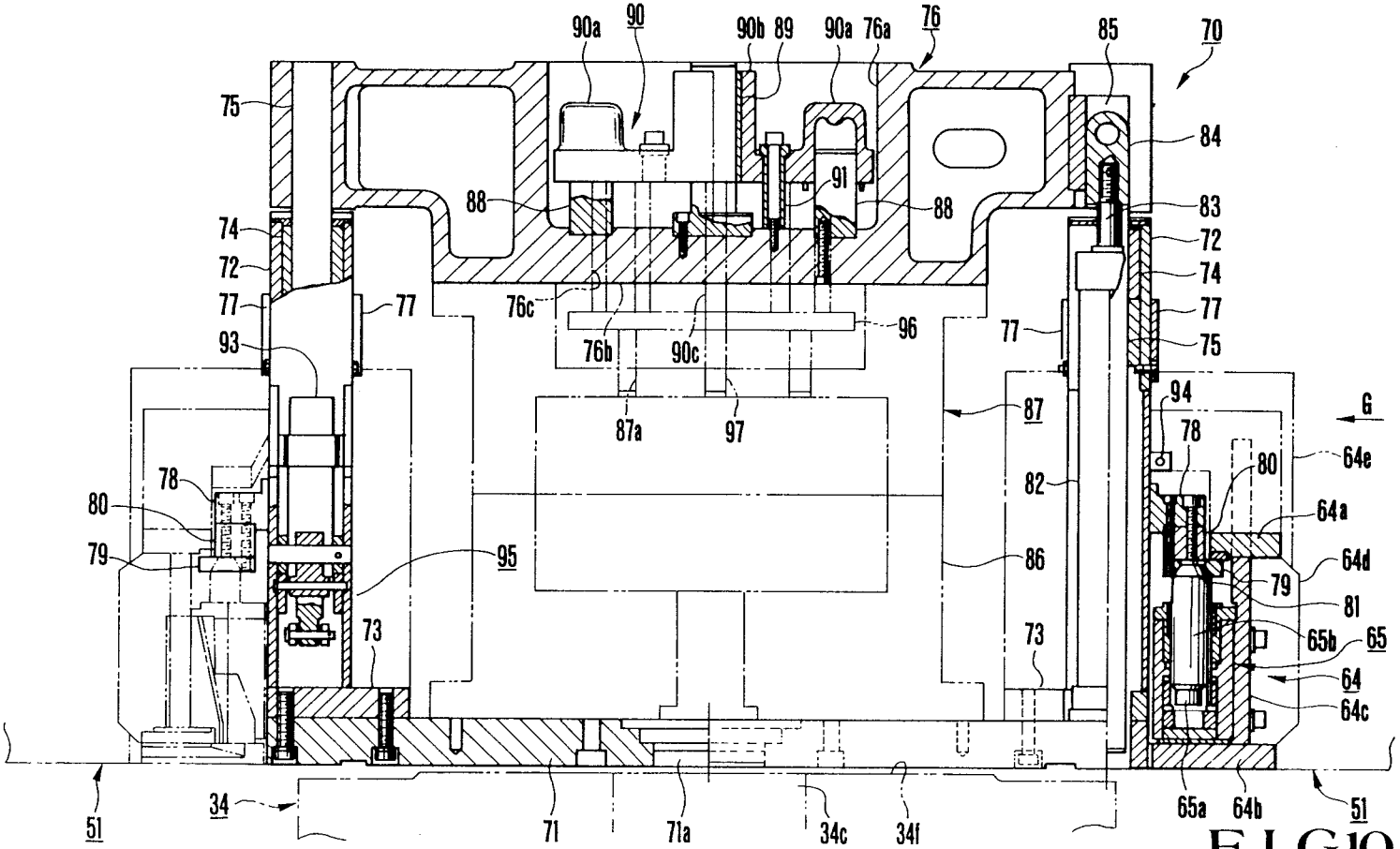
FIG. 10 is a sectional view illustrating a die open and close unit employed in the present invention.
Figure 11:
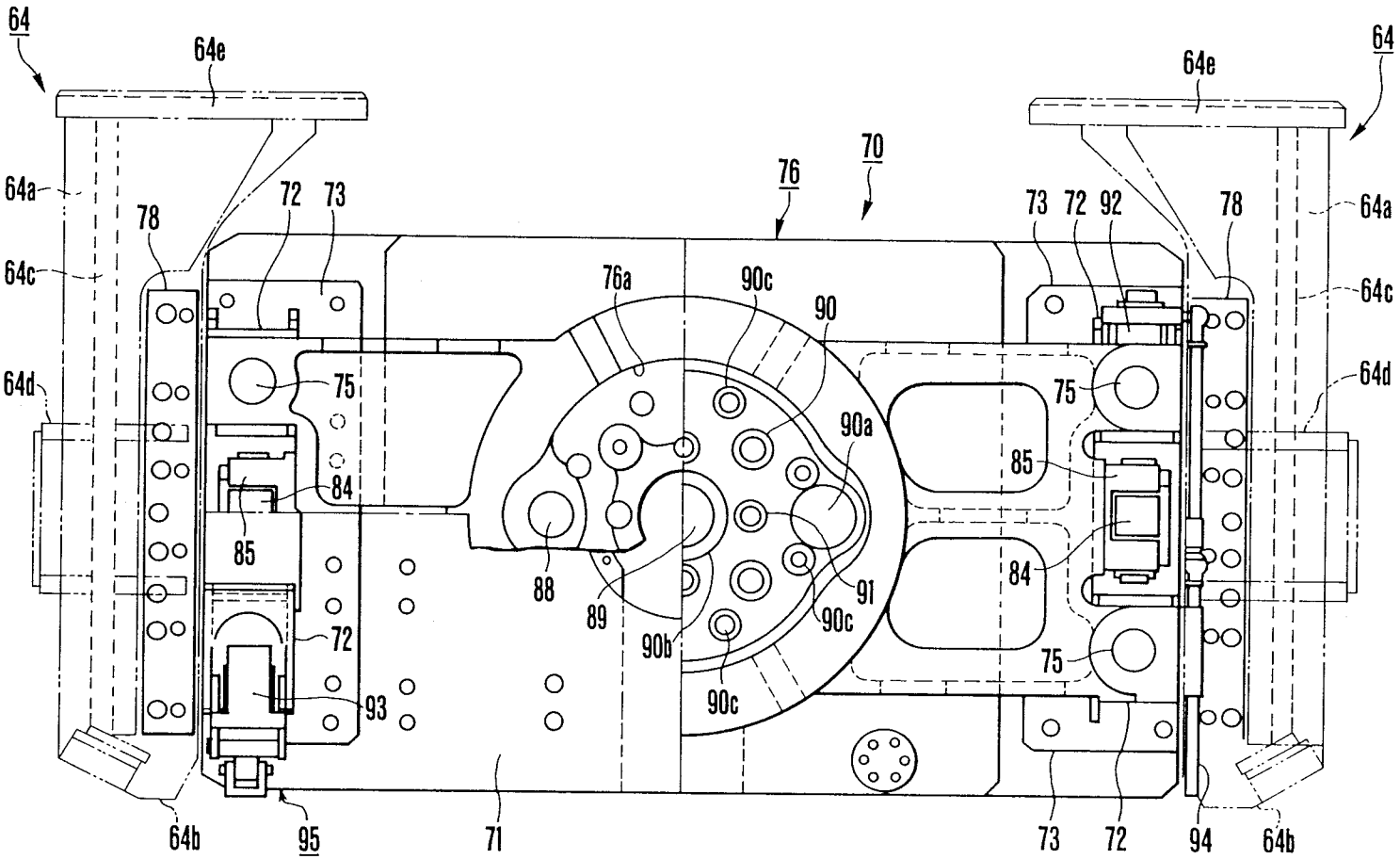
FIG. 11 is a plan view illustrating the die open and close unit of FIG. 10.
Figure 12:
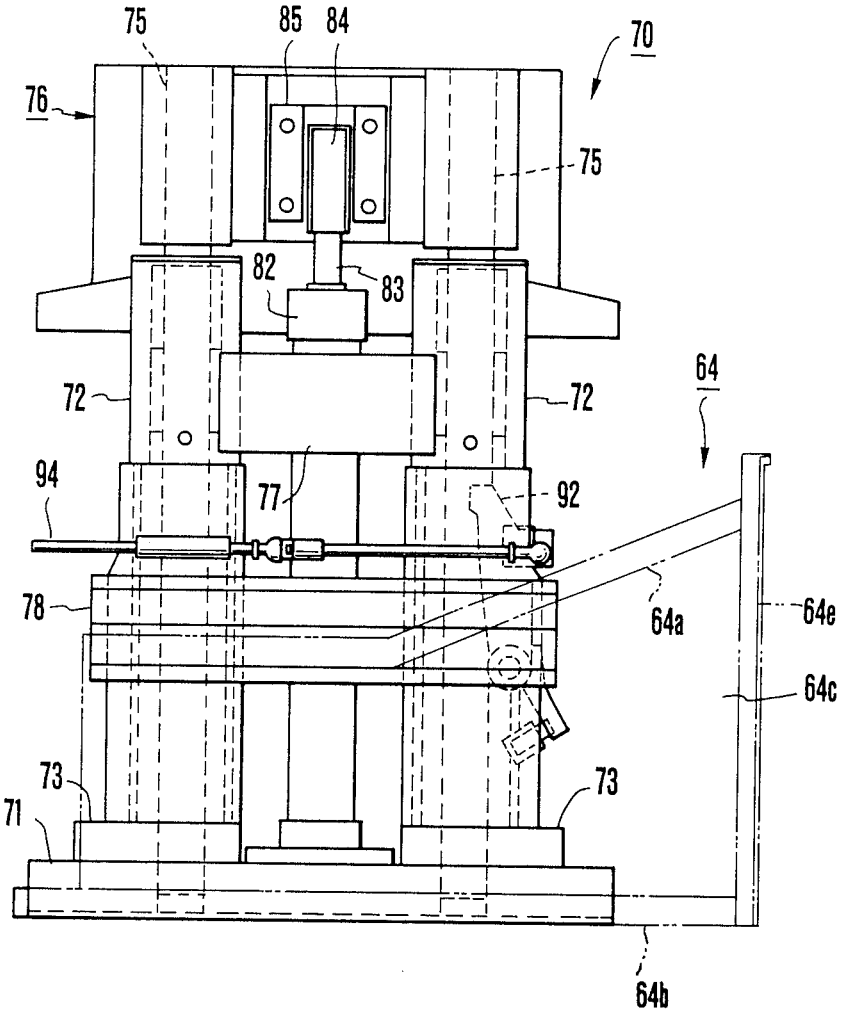
FIG. 12 is a side view as viewed in a direction of arrow G in FIG. 10.
Figure 24:
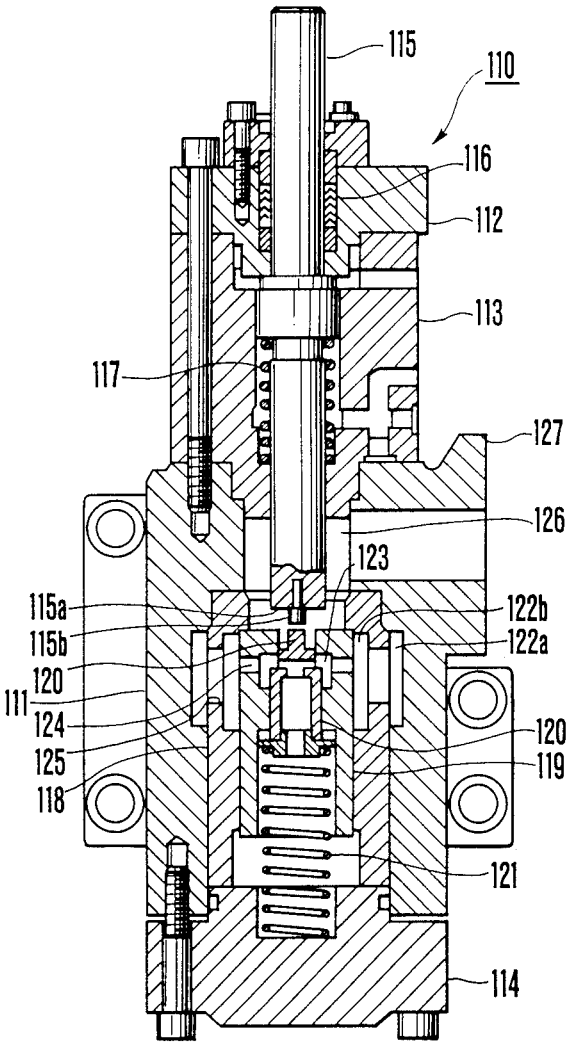
FIG. 24 is a longitudinal sectional view illustrating a safety valve for die clamping employed in the present invention.
Figure 25:
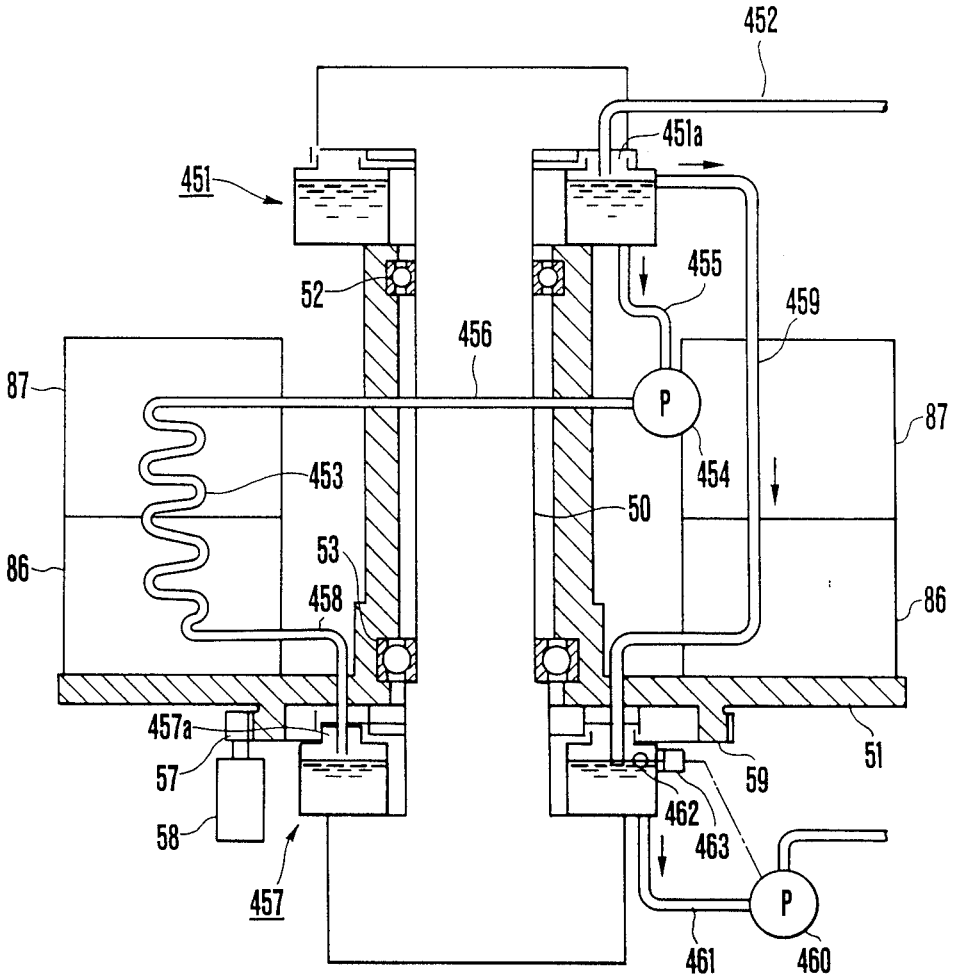
FIG. 25 is a schematic view illustrating a die cooling device according to a second embodiment of the present invention.
Figure 26:
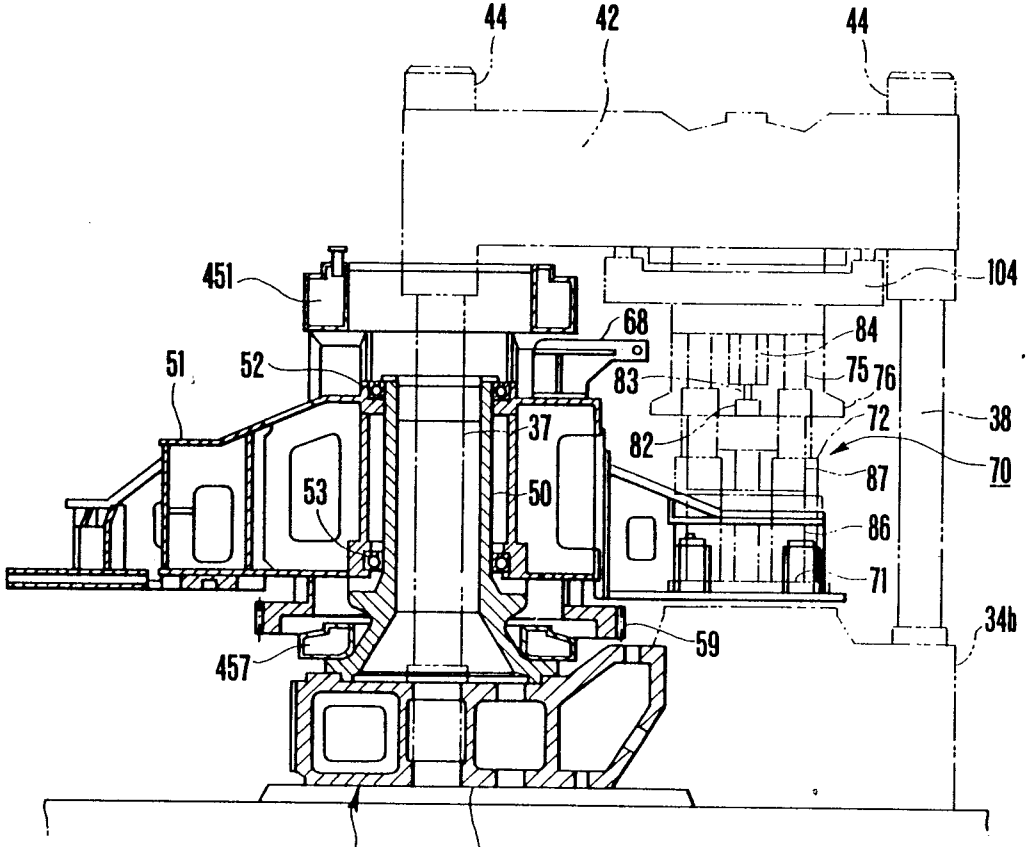
FIG. 26 is a sectional view schematically illustrating the rotary die casting machine provided with the die cooling device shown in FIG. 25.

The die clamping device and the injection device provided at the first station 30 will now be described with reference to FIGS. 2 through 5 and FIG. 10. As shown in FIG. 10, the die open and close unit 70, held by the rotary table 51, clamps both of the metal molds 86 and 87 at a predetermined low pressure when the top frame 76 is lowered and floats from the base platen 34 due to oil pressure of the push-up cylinders 65. When the rotary table 51 rotates under the above condition to bring the die open and close unit 70 to the first station 30 as shown in FIG. 2, the die clamping device 100 and the injection device 101 are in registration above and below the die open and close unit 70. The die clamping device 100 has a main ram 103 fitted into a ram hole 42*b* formed in the cylinder platen 42 and is vertically moved by pressurized oil introduced into a port 102. To the lower surface of the main ram 103, a moving platen 104 having a rectangular shape is fixedly bolted. An annular ground 105 is provided for holding a packing inserted into an engagement portion of the main ram 103 and bushes clamping of the packing from above and below. The annular ground 105 is bolted to the lower surface of the cylinder platen 42. Further, a frame-like spacer 106 opposing the top frame 76 of the die open and close unit 70 is bolted to the central portion of the lower surface of the moving platen 104. A pair of left and right pull-back cylinders, generally denoted by reference numeral 107, are fixed on the upper surface of the cylinder platen 42. Each of the pull-pack cylinders 107 has a stepped cylinder rod 109 which is fitted into a cylinder 108 through a bush and a packing and is vertically movable therewithin. The cylinder rod 109 vertically passes through the platen 42. Each cylinder rod 109 is fixed, at its lower end, to the moving platen 104. When introducing pressurized oil into the cylinder 108 to elevate the cylinder rod 109, the moving platen 104, lowered by the main ram 103, is caused to slightly rise to a position at which die clamping is released. Further, to one of the pull-back cylinders 107, a safety valve 110, which is detailed in FIG. 24, is additionally provided. This safety valve 110 is provided to prevent the moving platen 104 from being lowered accidentally. The safety valve 110 has a body integrally formed of a valve body 111 fixed to the cylinder 108, a flange 112, a cylinder block 113 and a flange 114. The components 112, 113 and 114 are vertically bolted to the valve body 111. A stepped rod 115 is supported by the flange 112 and the lower end portion of the cylinder block 113 through a packing 116 so that it is vertically movable. The rod 115 is upwardly biased by a compression spring 117 loaded within the cylinder block 113. The rod 115 has a planar lower end surface and a small diameter projection 115*b* extending from the center of the end surface. Into an inner hole of the valve body 111, a sleeve 118 is fitted. Into an inner hole of the sleeve 118, a vertically movable sleeve 119 is fitted to oppose the lower surface of the rod 115 coaxially therewith. Further, into an inner hole of the sleeve 119, another vertically movable sleeve 120 is fitted. A compression coil spring 121 is interposed between the sleeve 120 and the flange 114 to support the sleeve 120 in a static load condition. When the rod 115 is lowered, the compression coil spring 121 is initially compressed by the sleeve 120 which is pushed down by the tip of the small diameter projection 115*b* of the rod 115 through a plug 120*a*, and is then compressed by the sleeve 119 which is pushed down by the planar end surface 115*a* of the rod 115. In an ordinary condition, the upper limit positions of both of the sleeves 119 and 120 are so determined that these sleeves do not make contact with the rod 115.

Annular grooves 122*a*, 122*b* and 123 communicate with each other through communicating passages 124 and 125. The outer annular groove 122*a* communicates with an oil chamber provided above the main ram 103. An oil passage 126 is closed by the upward movement of the sleeves 119 and 120. The oil passage 126 is connected to an oil tank through an oil passage joined to a flange 127. A striker 128 is fixed to the cylinder rod of each of the pull-back cylinders 107 which pushes down the cylinder rod 115 when this cylinder rod is lowered. When the striker 128 pushes down the cylinder rod 109 upon accidental downward movement of the main ram 103, the small diameter projection 115*b* initially causes the plug 120*a* to open a portion between the annular groove 123 and the oil passage 126. The planar end surface 115*a* then causes the sleeve 119 to open a portion between the annular groove 122*b* and the oil passage 126. Thus, oil above the main ram 103 is returned to an oil tank through the safety valve 110 in two steps: initial drainage of a small amount of oil and subsequent drainage of a large amount of oil. This stops the downward movement of the moving platen 104 caused by the main ram 103. The reason for draining oil in two steps in an emergency is that if a large amount of oil is drained at once, such drainage is not carried out smoothly because of shock, vibration and the like.

The die clamping device 100 thus configured operates as follows: The die open and close unit 70 floats above the base platen 34 by the push-up cylinder 65 and virtually or temporarily clamps the metal molds 86 and 87 at a predetermined low pressure. When, with the rotation of the rotary table 51, the die open and close unit 70 has rotated and stopped directly below the die clamping device 100, the main ram 103 is lowered to eventually clamp the metal molds 86 and 87 at high pressure through the moving platen 104, spacer 106 and top frame 76, and at the same time to push the die open and close unit 70 against the metal mold contact member 34*f* of the base platen 34 in opposition to the push-up force of the push-up cylinder 65. When the moving platen 104 is elevated by the pull-back cylinders 107, the eventual clamping is released to return to the virtual clamping where only the die open and close cylinder 82 is operating and the die open and close unit 70 is pushed up by the push-up cylinder 65 to float from the base plate 34.

Figure 27:
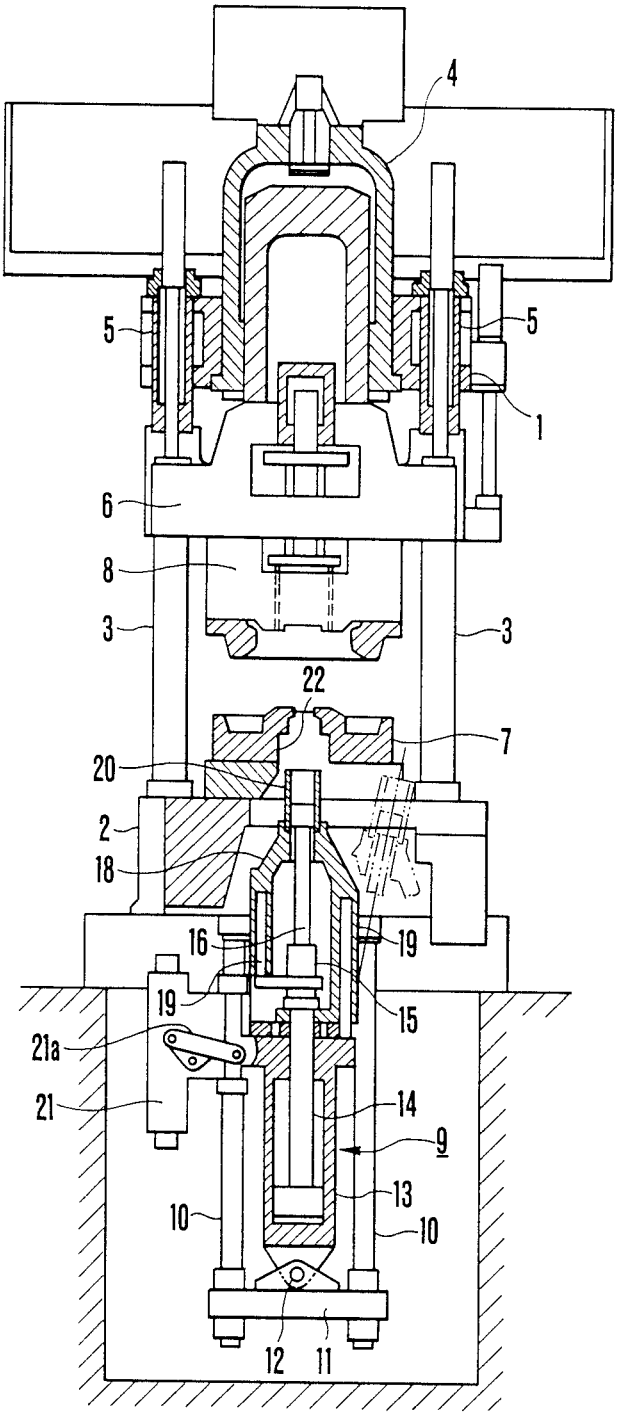
FIG.27 PRIOR ART
FIG. 27 is a longitudinal sectional view illustrating a conventional vertical die casting machine.

The injection device 101 employed in the present invention has substantially the same configuration as the conventional injection device shown in FIG. 27 and will be briefly described with reference to FIG. 2. Parts in FIG. 2 identical to those in FIG. 27 are denoted by the same reference numerals.

The plunger 16 is connected by means of the coupling 15 to the piston rod 14 which is vertically movable by oil pressure of the injection cylinder 9 supported by the tiebars 37 and 38 and frame 10 to suspend from the base platen 34. This plunger 16 is slidably fitted into the injection sleeve 20 supported by the block 18 which is vertically movable by the ram 19. The injection sleeve 20 moving upwardly by the ram 19 along with the block 18 is fitted into the stationary sleeve of the stationary metal mold 86. When the plunger 16 moves upwardly by the injection cylinder 9, hot molten metal within the injection sleeve 20 is injected into the cavity defined by the two metal molds 86 and 87 clamped by the die clamping device 100. Although indication thereof is omitted in FIG. 2, the tilting cylinder 21 shown in FIG. 27 for tilting the injection cylinder 9 to the phantom line position at which the hot molten metal is fed is additionally connected to the injection cylinder 9. Further, a hot molten metal automatic feed device, generally denoted by reference numeral 130 in FIG. 2, is additionally provided to the injection device 101. In this hot molten metal feed device, a device body 132 is supported by frames 131 uprightly provided at the end of the base platen 34 through a four-node link 133. The device body 132 is swingable by means of a turning cylinder (not shown) about a fulcrum of the four-node link 133 between the position shown and a position opposing the tilting cylinder, indicated by phantom line in FIG. 27, at a predetermined timing. A melting furnace 135 filled with hot molten metal 136 is provided on the floor. The device body 132 has a ladle 137 which is advanced into or retracted from the molten metal as indicated by an arrow in the figure or rotated in the molten metal by means of two servomotors 134. By advance or retraction, the ladle 137 is filled with the hot molten metal 136 and then moved to a position opposite the injection sleeve 20 of the tilting cylinder by turning the device body 132 so as to allow the hot molten metal 136 to be poured into the interior of the sleeve 20. The advancing, withdrawing or rotation of the ladle 137 and rotation of the device body 132 are automatically carried out by a control unit 300 at a predetermined timing.

A second station detailed in FIGS. 13 and 14 will now be described. The second station 140 has a pusher frame 142 of an isosceles triangular plan form bolted to the radial side surface of the rotary table 51 of the cylinder platen 42 provided at the first station 30 and is horizontally spanned. A line L having the base side of the isosceles triangle and connecting to an apex thereof and the center line L1 of the die clamping station 30 make an angle of 120 degrees as indicated in FIG. 1. On the radial side surface of the rotary table 51 of the base platen 34, a projecting cylinder frame 143 of Y-shaped plan form having an arm **143*a* and arms 143*c* and 143*d* branching from a boss 143*b* provided at the base of the arm 143*a* is provided through a bracket 144. Fixing pawl devices 145 secured at the ends of the arms 143*c* and 143*d* are connected by tiebars 146 to the opposite ends of the base side of the isosceles triangle of the pusher frame 142. The fixing pawl device 145 has a pawl which is horizontally advanced or withdrawn by an oil pressure cylinder 147 to engage or disengage the tip of the arm 64 of the rotary table 51, thus fixing the stopped rotary table 51 at a predetermined timing. The above-mentioned arms 143*c* and 143*d* are supported on foundations on the floor by means of brackets 148. The die open and close unit 70, holding the metal molds 86 and 87 by which a casting has been finished at the first station 30, is held by the rotary table 51 and turned to the thus constructed second station 140** during the process of cooling the product. At this position, after the product is cooled, the die is opened and the product is taken out.

A construction (see FIGS. 13 and 14) which has not been explained in connection with the die open and close unit 70 will now be described. The projection cylinder 149 is supported by the boss **143*b* of the projection cylinder frame 143. The projection cylinder 149 contains the piston rod 149*c* which is vertically movable by selectively feeding oil to ports 149*a* or 149*b*. In accordance with the upward movement of the piston rod 149*c* by oil pressure, the projection cylinder projects to the die cavity through center holes formed in the fitting bed 71 of the die open and close unit 70 and the stationary metal mold 86. Simultaneously with the upward movement of the piston rod 149*c*, the top frame 76 of the die open and close unit 70 holding the movable mold 87 moves upwardly by the die open and close cylinder 82. After the die opening is thus carried out, the product, of which a "biscuit" portion is pushed out by the piston rod 149*c*, moves upwardly by being held in the cavity of the movable metal mold 87. A piston rod 151 of a pusher cylinder 150 fixed on the upper surface of the pusher frame 142 is fitted into a cylinder fitting hole 142*a* formed in the pusher frame 142 and in register with the lower boss 143*b*. A half-split cylindrical coupling 152 is fixed in a split-clamped manner to the piston rod 151. The lower end surface of the coupling 152 opposes the boss 90*b* provided on the ejector frame 90 of the die open and close unit 70. When the piston rod 151 moves downwardly by oil pressure, the ejector frame 90 is lowered in opposition to the oil pressure of the cylinder 90*a*. The ejector frame 90 has a plurality of pins 90*c* (twelve in this embodiment) which project downwardly through pin holes 76*c*. To the lower end of the pins 90*c*, a pusher plate 96 is fixed in a manner so that it is disposed in parallel with the lower surface of the top frame 76 and is fitted into a recessed portion of the movable metal mold 87. Further, from the lower surface of the pusher plate 96, a plurality of pusher pins 97 project. These pusher pins 97 are inserted into pin hole 87*a* formed in the movable metal mold 87 to extend to the wall of the die cavity. With the above-mentioned construction, when the piston rod 151 of the pusher cylinder 150 is lowered with the die opened as stated above, the boss 90*b* is pushed down by the coupling 152 so that the ejector frame 90 is lowered and the pusher pins 97 are pushed down through the pusher plate 96 to push the product within the cavity out of the movable metal mold 87**.

A device for receiving the product pushed out of the movable metal mold 87 to take it out to the outside of the apparatus will be described with reference to FIG. 1 and FIGS. 15 to 17. From a position on a line branching from the line connecting the center of the first station 30 and the center of the second station 140, a base bed 161 of the device 160 for taking out the product which has a rectangular plan form extends in a direction perpendicular to the branching line. The base bed 161 is fixed on the floor near the second station 140. On rails 162 laid on the base bed 161, a frame 163 is provided so that it runs on a plurality of wheels 164 rotatably mounted to a frame base 163*a* roll. An oil pressure cylinder 165 is provided for moving the frame 163. The operating end of a piston rod 166 is fixed to the frame base 163*a*. The frame 163 runs between positions at which a striker 169 comes in contact with an advance limit switch 167 and a withdrawal limit switch 168. Guide rollers 170 are provided for limiting lateral vibration. The frame 163 normally advances during use of the apparatus and withdraws to a withdrawal position when the die is mounted or dismounted (as will be described later). On an arm support 171 in the form of a frame which stands uprightly at the front end of the frame base 163*a*, a box-shaped bearing box 172 is fixed. The bearing box 172 has a side plate to which an oil cylinder 173 having a long stroke of about 2 m is horizontally secured. To the operating end of a piston rod 174 of the oil pressure cylinder 173, a bracket 175, T-shaped in side elevation, is fixed. On the upper end, serving as the operating end, of a piston rod 177 of an air cylinder 176 suspending from a horizontal member of the bracket 175, a horseshoe-shaped saucer 178 having an opened side is supported so that its upward and downward movement can be adjusted by the air cylinder 176. A pair of guide shafts 179, one end of each of which is fixed in parallel to the piston rod 174 to the bracket 175, are journalled by the bearings provided in the bearing box 172 and extend in parallel to the oil pressure cylinder 173. The tip ends of the paired shafts 179 are joined to plate 180. The bracket 175 and the joint plate 180 are joined to each other by a pair of stays 181 each provided with a striker 181*a*. With the construction stated above, when the piston rod 174 of the oil pressure cylinder 173 advances from a position shown, the saucer 178 advances to the center of the product taking-out station 140 along with the bracket 175, guide shafts 179, joint plate 180, and stays 181. At this advanced position, the piston rod 177 of the air cylinder 176 is actuated to elevate the saucer 178 to a predetermined position convenient for receiving the product so as to receive the product pushed out of the movable metal mold 87 as previously described, and thereafter the piston rod 177 is retracted to return the saucer 178 to a position shown. A plurality of limit switches 182 are operated in response to contact with the strikers 181*a* to limit the advancing and withdrawing movement of the saucer 178 and to stop or decelerate the saucer 178 at an intermediate position.

Adjacent the arm support 171 of the frame base 163*a*, a water cooling frame 183, L-shaped in side elevation, is provided uprightly. At the lower broad portion of the frame 183, a water tank 184 is provided. At a position slightly above the middle of the water cooling frame 183, an arm shaft 185 extending on the frame is rotatably supported. At one end of a lever 186 integral with the central portion of the arm shaft 185, a piston rod of an oil pressure cylinder 187 is pivotally mounted. The cylinder 187 is supported by the water cooling frame 183. To the opposite ends of the arm shaft 185, a pair of arms 189 having pivotal rollers 188 at their tips are fixed. By advancing and withdrawing the piston rod of the oil pressure cylinder 187 under the application of oil pressure, the arms 189 rotate through an angle of substantially 90 degrees between the horizontal attitude and the vertical attitude. A pair of upper and lower strikers 190 move vertically together with the piston rod. Limit switches 191 are operative, when the strikers 190 make contact therewith, to stop the arms 189 at the horizontal and vertical limits of the rotation of the arms 189. Near the arm shaft 185, notches are formed in the opposite sides of the frame 183. A pair of parallel guide rails 192 are provided in notches in either side. Supported by either pair of guide rails 192 are a pair of rollers 193 which are vertically movable therealong. A water cooling cage 194 is fixed at one end thereof to a shaft supporting the pair of rollers 193 and is supported at the central portion thereof by the pair of rollers 188. The cage 194 has a channel shape which is defined by both side plates and a bottom plate. The cage moves upwardly and downwardly between the position shown and a position within the water tank 184 in response to upward and downward movement of the rollers 193 while rotating between the horizontal attitude and the vertical attitude in response to the rotation of the arms 189. A pair of limit switches 195 are fixed to a bracket 196 which stands uprightly on the frame 183. Strikers 197 are supported by a shaft 198 which is integral with a non-rotating member of the rollers 193 and stands uprightly. When the rollers 193, and hence the strikers 197, move vertically along with the cage 194 and engage the limit switches 195, the cage 194 is stopped at upper and lower limits.

Near the cooling water frame, a puller frame 199 is provided uprightly on the frame base 163*a*. To the planar top of the puller frame 199, a bracket 200 is connected which extends horizontally toward the cage 194. An oil pressure cylinder 201 is supported by the upper portions of the bracket 200 and the puller frame 199 so that it extends in a direction perpendicular to the oil pressure cylinder 173. To the operating end of a piston rod 202 advancing and withdrawing by oil pressure of the cylinder 201, a vertical plate 203 is fixed. A pair of stays 204 and guide rods 205 are fixed, at one end, to the vertical plate 203 to extend parallel to the oil pressure cylinder 201. The stays 204 and guide rods 205 are connected, at the other end, to a channel-shaped joint plate 206. The guide rods 205 are supported by bearings provided on the bracket 200 and can advance or withdraw. At the lower end of the vertical plate 203, a puller 207 is provided which has an arcuate surface as shown in plan view in FIG. 17. The puller 207 advances and withdraws together with the piston rod 202. When the saucer 178 is not located at a position shown in FIG. 17 because it is located at an advanced position for receiving the product, the puller 207 is advanced along with the piston rod 202 and stopped at a position as indicated by phantom line in FIG. 17. The puller 207 stays at this position until the saucer 178, which has received the product, is returned to the position shown. Accordingly, at this time, by withdrawing the puller 207 by substantially one-half stroke along with the piston rod 202, the product on the saucer 178 is drawn into the cage 194 which is substantially flush with or slightly below and in front of the saucer 178. Subsequently, as the cage 194 is rotated and lowered as stated above, the product held by the cage 194 is brought into and water-cooled at the water tank 184. Thereafter, the cage 194 is returned to the position shown. A shoot 208 opposing the bracket 200 is directed to the floor. By withdrawing the piston rod 202 by the remaining half-stroke, the product, which has undergone water cooling within the cage 194, is pulled out by the puller 207. The product thus pulled out slides on the shoot 208 and is then piled onto the floor or a conveyance bed. A plurality of strikers 209 are provided on the stays 204. Limit switches 210 are fixed to the bracket 200. When the strikers 209 engage the limit switches 210, the limit switches 210 stop the piston rod 202 at the advance limit position, the withdrawal limit position or the product water-cooling position.

A third station will now be described. In contrast to the other stations 30 and 140, the third station 220 is not provided with a frame structure supported by tiebars. The rotary table 51 stops at the third station in order for preparatory operations to be carried out. A stop center line L2 indicated by dash and dot line in FIG. 1 makes an angle of 120 degrees with respect to the stop center lines L and L1 of the other stations 30 and 140. The molds 86 and 87, which are opened and held by the die open and close unit 70, are brought to this station 220. Accordingly, at the third station the molds 86 and 87 are cleaned by spraying, applied with mold release and mated. If necessary, an insert is loaded.

The outline of a well-known die spraying device, denoted by reference numeral 221 in FIG. 1, will now be described. On a frame 222 fixed on the floor, an arm holder 223 is fixed, the center line of which is directed toward the center of the die open and close unit 70. A piston rod 225 of an oil pressure cylinder 224 is fixed to the arm holder 223. Extending along the center line thereof, an arm structure 229 is fixed. The arm structure 229 has a frame structure comprising front and rear point plates 226 and 227 and a pair of guide rods 228 movably supported by the arm holder 223. Ahead of the front joint plate 226, a spray head 232 is provided which comprises a water receptacle 230 and upper and lower blocks 231. The spray head 232 can be rotated in a horizontal plane by means of an internal gear unit. To the upper and lower blocks 231, piping for mold release and air piping is delivered. When the spray head 232 is advanced to the center of the die by using the oil pressure cylinder 224 and rotated thereat, air is ejected to clean the metal molds. Further, the mold release mixed with air is ejected and applied to the molds. A well-known insert loading device denoted by reference numeral 223 in FIG. 1 is provided. When an insert is to be loaded into the product, a head 235 is advanced into the die by using an oil pressure cylinder 234 and an insert is loaded within the cavity. The metal molds 86 and 87, which have been cleaned and applied with mold release as stated above, are mated by lowering the top frame 76 holding the movable metal mold 87 by means of die open and close cylinder 82. As a result, a necessary minimum die clamping force (virtual or temporary) is applied to the metal molds 86 and 87 and maintained. As previously described, the die open and close unit 70 is pushed up by the push-up cylinder 65 so as to float above the base platen 34. The floating unit 70 is then sent to the first station 30 by the rotation of the rotary table 51.

A device for mounting to or dismounting from the rotary table 51 the metal molds 86 and 87 mounted to the die open and close unit 70 will now be described. As shown in FIGS. 1 and 2, below the die open and close unit holder 55A of the rotary table 51 being stopped at the second station 140, a frame 240 integrally formed of a plurality of legs and a frame member thereon is provided on the floor uprightly. The frame 240 is so arranged as not to interfere with the projection cylinder 149. Rollers 241 are respectively journalled on a plurality of sets of bearings arranged in parallel on both sides of the upper surface of the frame 240. On the floor contiguous to the frame 240, a frame 242 is provided uprightly which is integrally formed of a plurality of legs and a long frame member connected to the upper ends of the legs and to the frame 240. Rollers 243 are respectively journalled on a plurality of sets of bearings arranged in parallel on both sides of the upper surface of the frame 242. A chain is applied on sprockets which are coaxial with the respective rollers 241 and 243. One sprocket is coupled with an output shaft of a reduction device 244 through a chain. A motor 245 and a reduction device 244 are coupled through a belt. In accordance with forward or backward rotation of the motor 245, all the rollers 241 and 243 are rotated simultaneously in a forward or backward direction. To mount the metal molds 86 and 87 to the rotary table, the metal molds 86 and 87 mounted in advance to the die open and close unit 70 are placed on the rollers 243 of a die preparation device 246. When the motor 245 is rotated in the forward direction with the rams **65*b* of the push-up cylinders 65 of the rotary table 51 lowered, the die open and close unit 70 advances by rotation of the rollers 241 and 243. When the unit 70 reaches above the arm 64 of the rotary table 51 so that the front end of the unit 70 engages the stoppers 68, a limit switch provided below the rollers 241 is actuated by the action of a striker pushed down by the die open and close unit 70. As a result, the die open and close unit 70 is stopped at a predetermined position. Then, by elevating the rams 65*b* of the push-up cylinders 65, mounting of the die to the apparatus is completed. Where the metal molds 86 and 87 are to be taken out from the rotary table 51 for die exchange or like purposes, they can be taken out onto the rollers 243 by performing the reverse of the above-mentioned operation. In the case of die exchange, a new die open and close unit 70 filled with a new die is suspended by a hoist or equivalent device and, immediately after the previous die open and close unit 70 is taken out, the new unit 70 is placed on the rollers 243 and advanced. The above operations are related to the other stations 30 and 240** as will be described later.

A device for automatically mounting or dismounting pressurized oil hoses, die water-cooling piping and electric wiring to or from the die open and close unit 70 detachably mounted on the rotary table 51 will now be described with reference to FIGS. 18 to 22. This automatic mount or dismount device includes a female coupler provided for the rotary table 51 and a male coupler detachably coupled to the female coupler and provided for the die open and close unit 70. These couplers are coupled or uncoupled by means of an operation mechanism provided for the second station 140. The parts 64 and **64*a*, indicated by phantom line in FIGS. 18 and 19, correspond respectively to the arm 64 of the rotary table 51 and the horizontal member 64*a* thereof shown in FIG. 9. To the base of the horizontal member 64*a* of one arm 64, a frame 250, U-shaped in front view and inverse L-shaped in side view, is fixed through a frame washer. The frame 250 comprises horizontal members 250*a*, a pair of vertical members 250*b* and a base plate 250*c*. An H-shaped adapter mount plate structure 255 is supported by bearings 250*d* formed at the tip portions of the left and right horizontal members 64*a* and comprises a horizontal long mount strip plate 253 and a pair of rods 254 passing through axial holes formed in opposite ends of the plate 253 and fixed thereto. The structure 25 is vertically movable along the rods 254. A compression coil spring 254***a* is interposed between a rod cap 257 and the bearing 250*d* to bias the adapter plate 255 in the upward direction. In the condition shown in the figures, the compression coil spring 254*a* is compressed so that the adapter mount plate 255 is lowered. Parts 72 and 78 indicated by phantom lines in FIGS. 19 and 21 correspond respectively to the bracket 72 and the stay 78 of the die open and close unit 70 shown in FIG. 10. On the stay 78, a death plate generally denoted by reference numeral 256 is fixed. The death plate 256, U-shaped in front view and rectangular in plan view, is formed, at opposite ends on its upper surface, with bearings 256*a* having bushes 256*b*. The above-mentioned left and right rods 254 are removably fitted into the bearings 256*a*. Between the death plate 256 and the adapter mount plate 255, a pusher plate 258 is provided which comprises a rectangular plate 258*a* and bearings 258*b* provided at opposite ends thereof. The bearings 258*b* are slidably fitted on the rods 254. At diagonal corners of the plate 258*a*, rods 259 stand uprightly by being fixed with nuts. The rods 259 penetrate through rod holes formed in the mount plate 253 to project upwardly. Between an upper flange of the rod 259 and the mount plate 253, a compression coil spring 60 biasing the rod 259 upwardly is provided. As long as the rod 259 is not pushed down from above, the rod 259 and the pusher plate 258 are supported with the compression coil spring 260 completely stretched.

Figure 13:
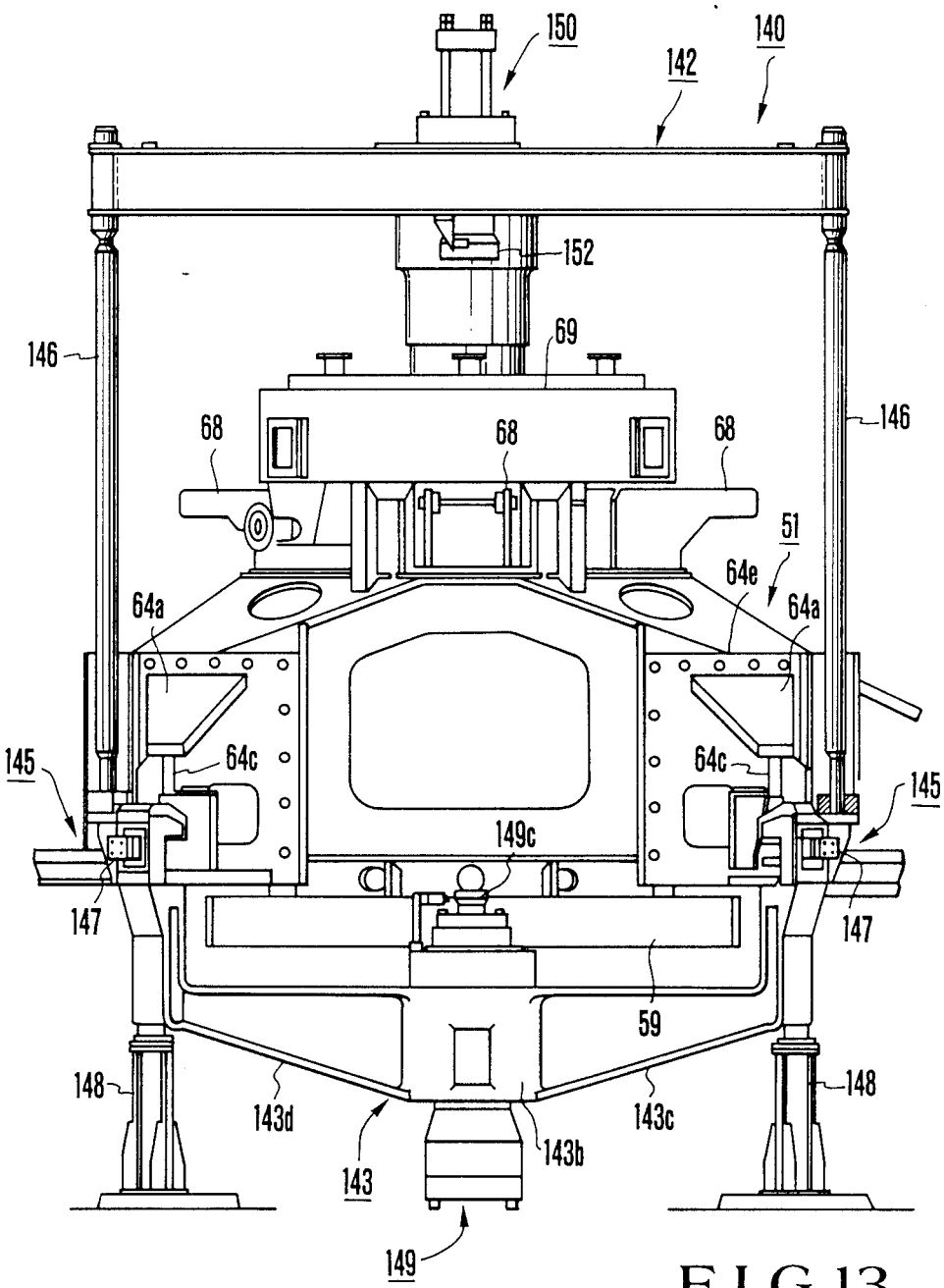
FIG. 13 is a front view illustrating a second station employed in the present invention.
Figure 14:
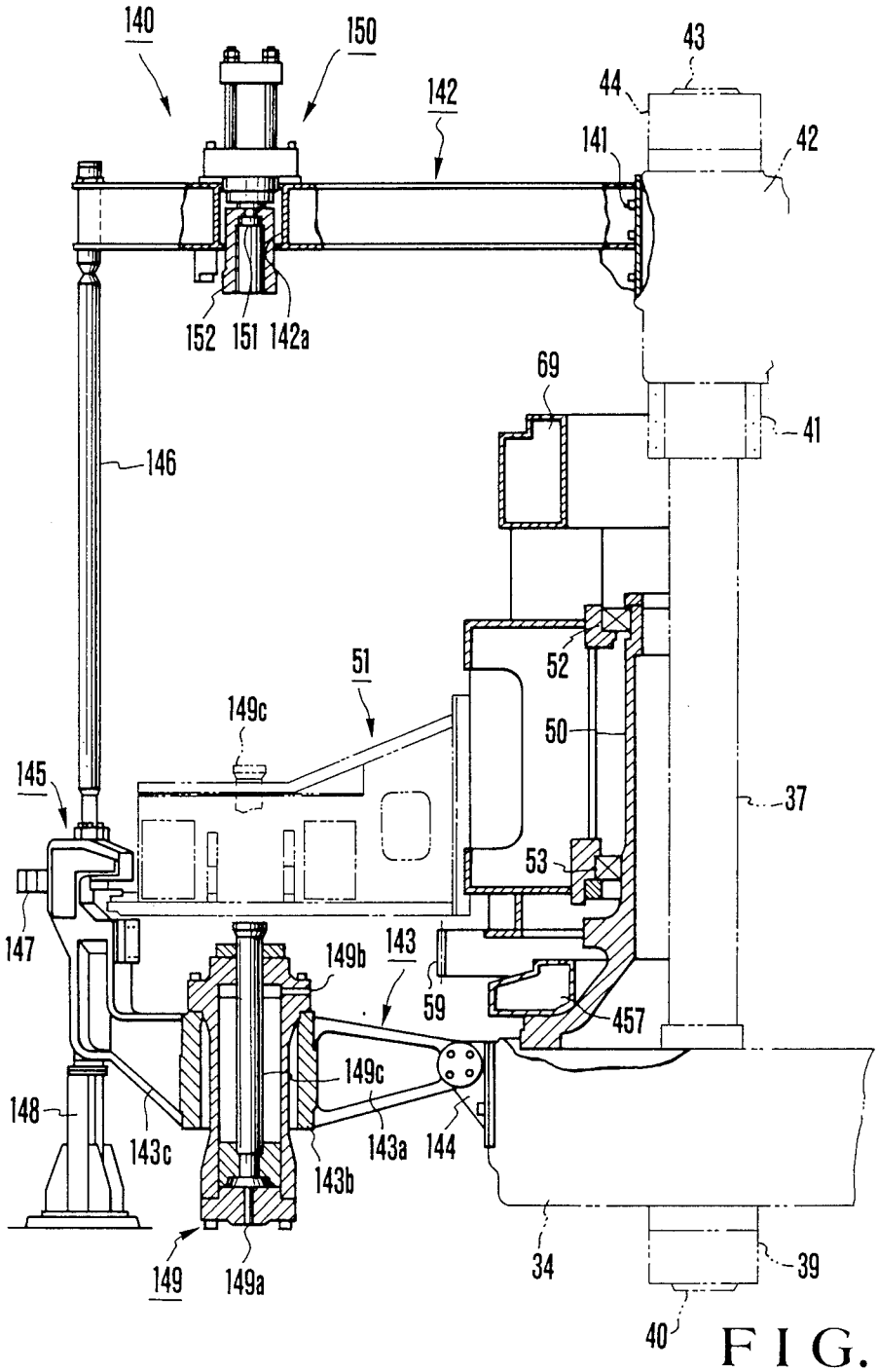
FIG. 14 is a side view illustrating the second station of FIG. 13.
Figure 15:
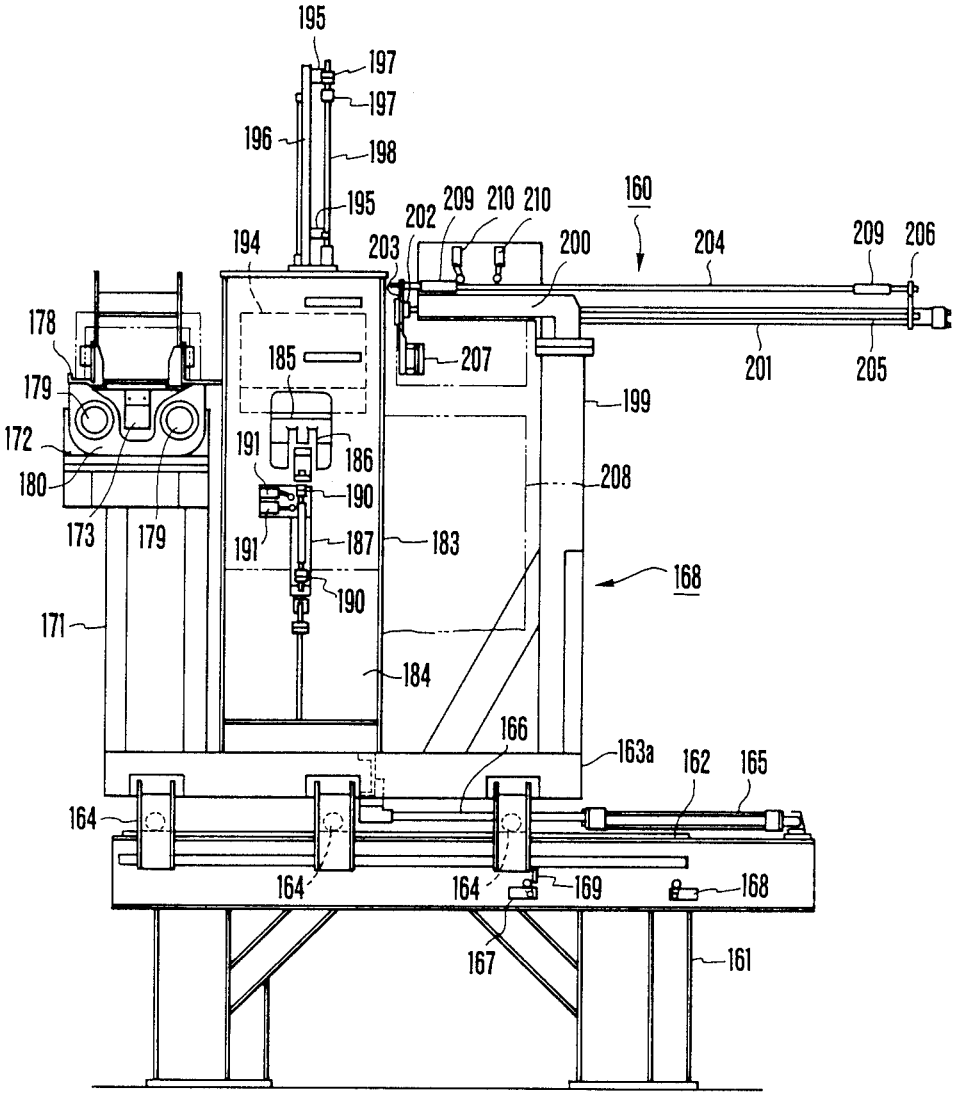
FIG. 15 is a front view illustrating a device for taking out products employed in the present invention.
Figure 16:
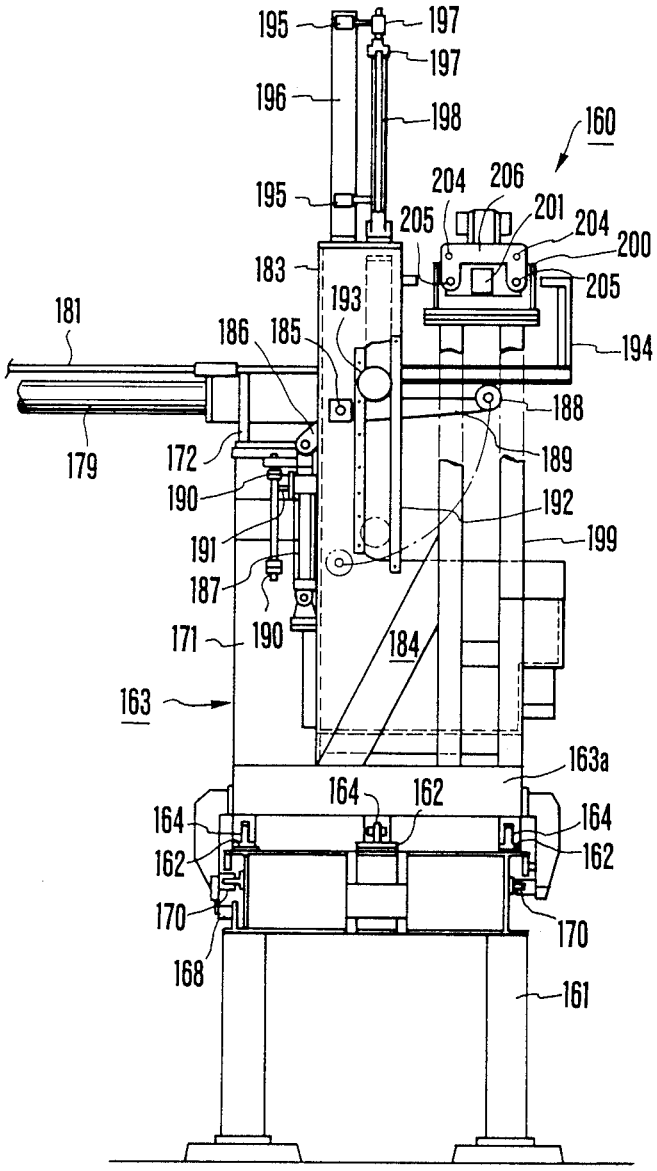
FIG. 16 is a side view illustrating the product take-out device of FIG. 15.
Figure 17:
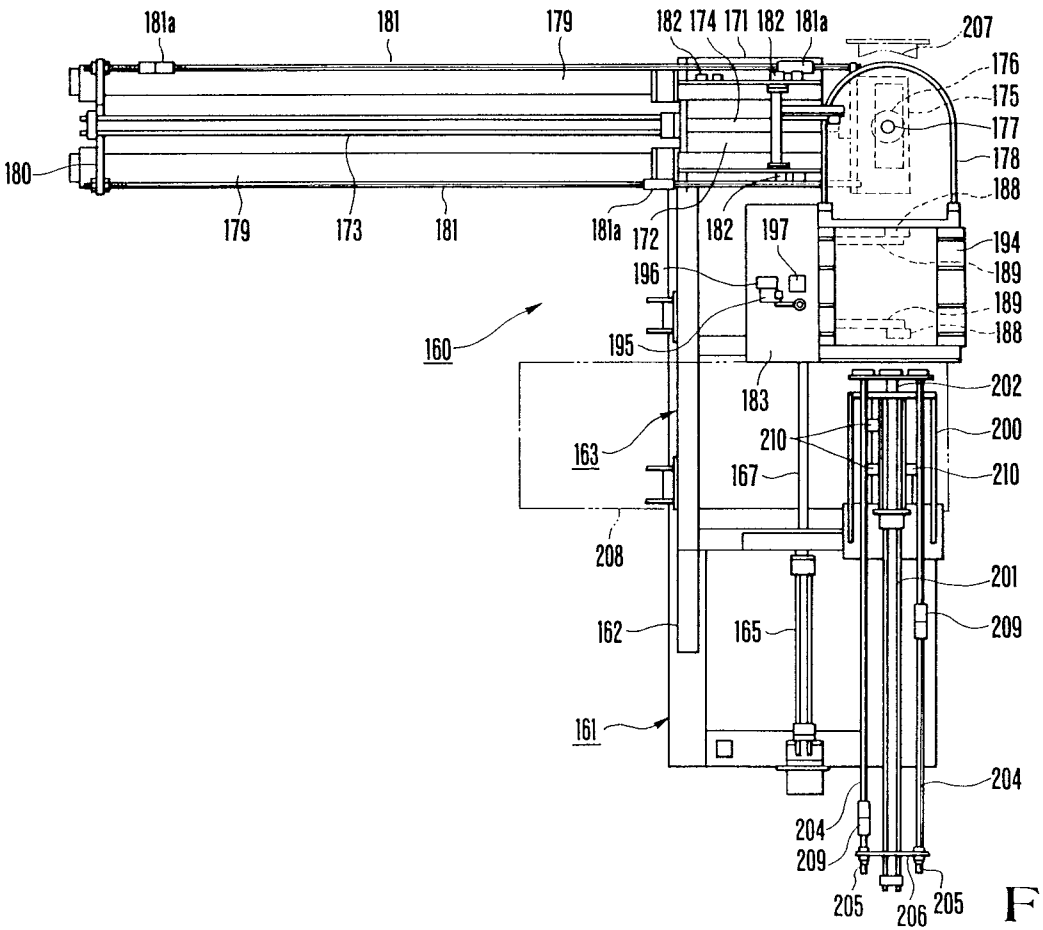
FIG. 17 is a plan view illustrating the product take-out device of FIG. 15.
Figure 18:
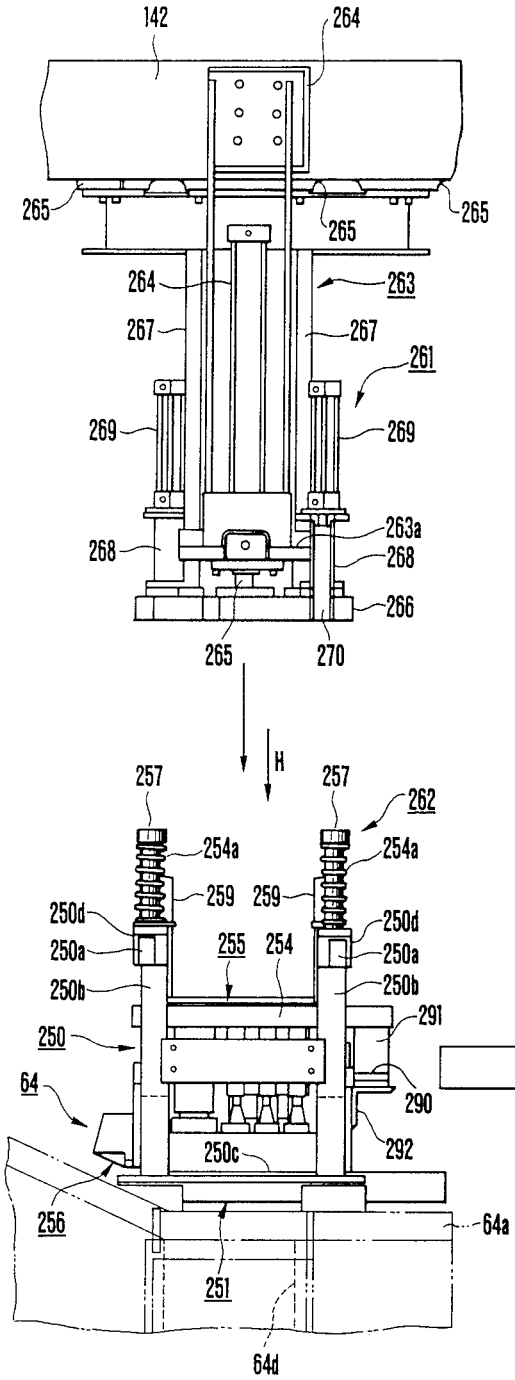
FIG. 18 is a front view illustrating an automatic coupler mount and dismount device employed in the present invention when set at upper and lower positions.
Figure 19:
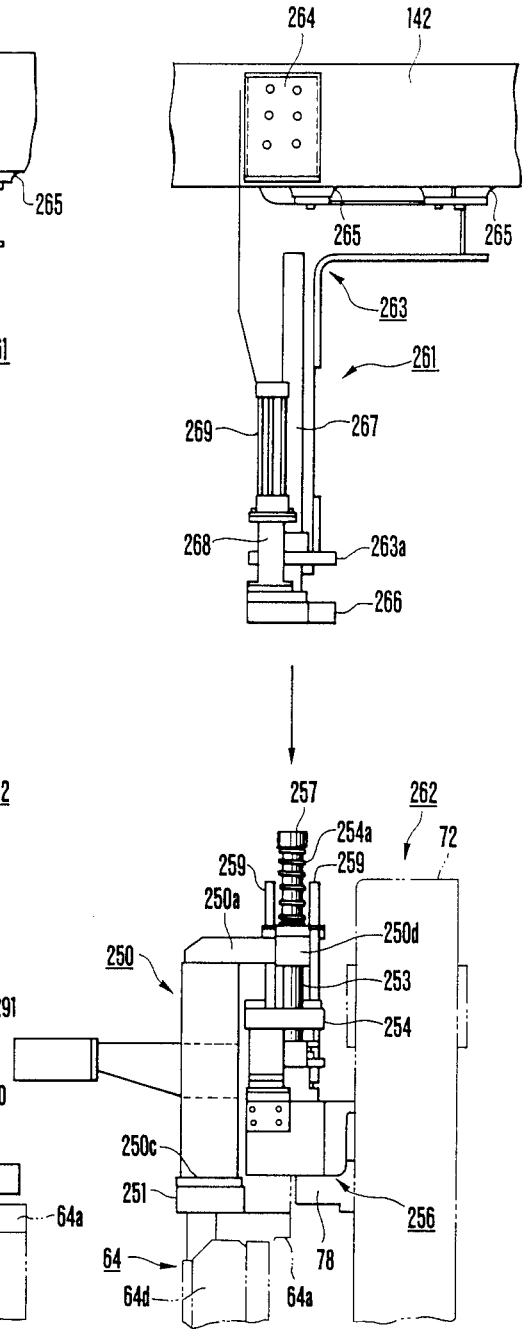
FIG. 19 is a side view illustrating the device of FIG. 18.

A part denoted by reference numeral 142 in FIGS. 18 and 19 corresponds to the pusher frame 142 shown in FIGS. 13 and 14. To the pusher frame 142, a depressing mechanism generally denoted by reference numeral 261 is mounted to oppose the above-mentioned coupler operation mechanism 262. A frame 263 of an L-shape in side view suspends from the pusher frame 142 through mount washers 265. On a supporting plate 263*a* provided at the lower end of the frame 263, an oil pressure type main cylinder 264 is provided uprightly. To the lower end of a piston rod 264*a* of the main cylinder 264, a rectangular pusher plate 266 is fixed. A pair of guide rods 267, the lower ends of which are fixed by the pusher plate 266, are slidably fitted into holes formed in the supporting plate 263*a* so as to project upwardly. Further, at diagonal corners of the pusher plate 266, a pair of rod guides 268 are provided uprightly. The rod guides 268 oppose the rods 259. On the upper end surfaces of the respective rod guides 268, oil pressure-type auxiliary cylinders 269 are uprightly fixed. A push rod 270 serving as a piston rod of the auxiliary cylinder 269 is fitted into the rod guide 268 to extrude out of the lower opening end of the rod guide 268 or withdraw thereinto. Further, by the actuation of the main cylinder 264 and the auxiliary cylinders 269, the rod caps 257 along with the rods 254, and the rod 259, are independently pushed down through the pusher plate 266 and the push rods 270. Thus, a mount or dismount operation of the coupler is carried out which will be described below.

Specifically, three kinds of plug adapters 271, 272 and 273 of different sizes (large, medium and small) are resiliently supported on the mount plate 253 by means of nuts 274 and square springs 275 which clamp the plate 253 from above and below. In addition, in a recessed portion of the death plate 256, three kinds of adapters 276 and 277 of different size (large, medium and small, the indication of the small one being omitted) are fixed to oppose the plug adapters 271, 272 and 273. Couplers 278 and 279 (the indication of the small one being omitted) are screwed on the adapters 276 and 277. The configuration of the couplers 278 and 279 is omitted in FIG. 22 but detailed in FIGS. 23A to 23D for explaining the operation. Accordingly, the configuration and the operation of the coupler 278 will be described with reference to FIGS. 23A to 23D. The coupler 278 comprises a male coupler 280 meshed with a lower threaded portion of the plug adapter 271 and a female coupler 281 meshed with the adapter 276. The male coupler 280 is formed of a cylindrical coupler body 282 having a valve seat at its lower end and a valve 283 slidabaly supported in the inner hole of the coupler body 282 through a bush. The valve 283 is biased in a direction of closing the valve seat by a valve spring 284. The female coupler 281 is formed of a cylindrical coupler body 285 having a valve seat in the central portion of the inner hole and a valve 286 slidably supported by the inner hole of the coupler body 285 through a bush. The valve 286 is biased in a direction of closing the valve seat by a valve spring 287. Into a plurality of ball holes formed in the coupler body 285 near the upper opening thereof, balls 288 are fitted, respectively. On the upper half of the outer peripheral surface of the coupler body 285, a cylindrical sleeve 289, biased upwardly by a spring member not shown, is slidably fitted, with its lug fitted into a groove 285*a* formed in the outer peripheral surface of the coupler body 285. At the upper end of the sleeve 289 and the outer peripheral surface of the male coupler body 282, recesses 289*a* and 282*a* are provided with which the balls 288 engage. When both the couplers 280 and 281 are coupled together, the above-mentioned recesses are in engagement with the balls 288.

Figure 20:
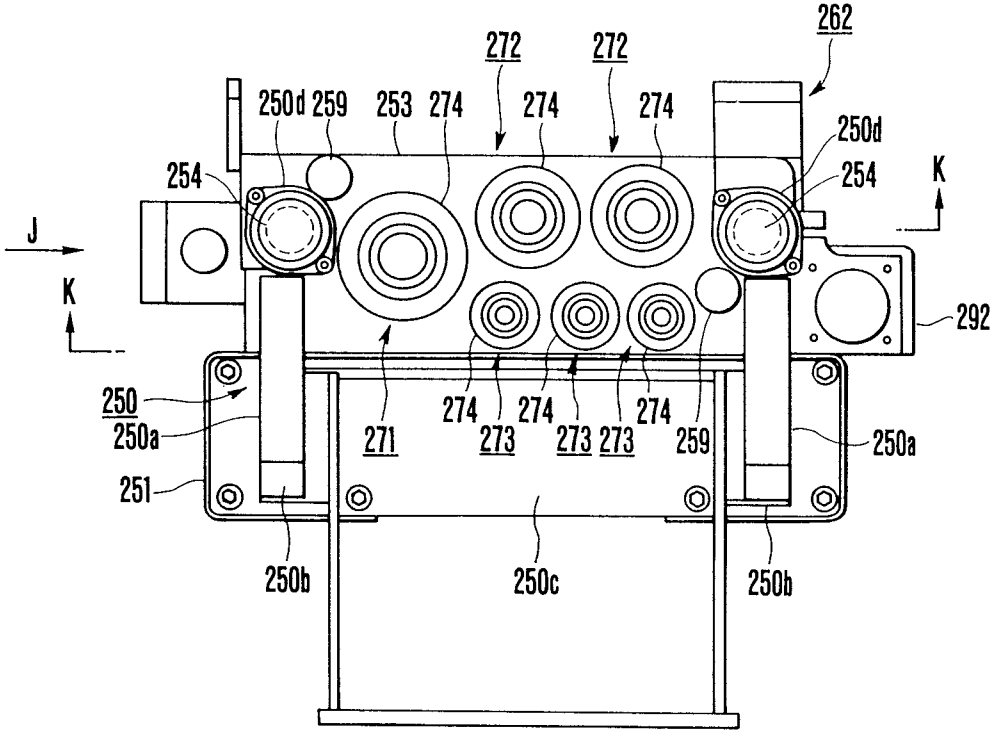
FIG. 20 is an enlarged plan view as viewed in a direction of arrow H in FIG. 13.
Figure 22:
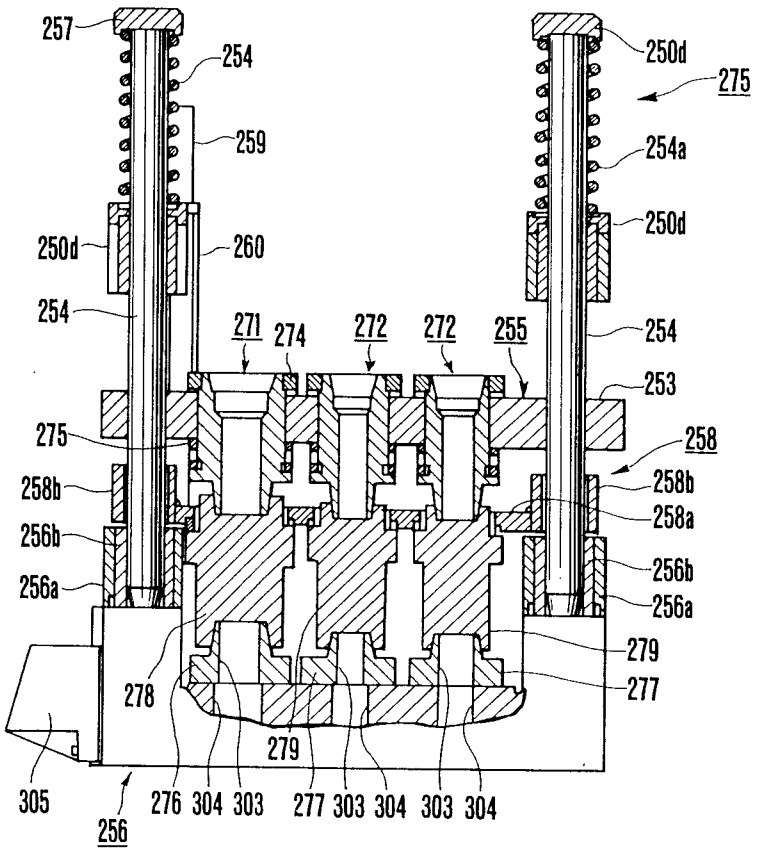
FIG. 22 is a sectional view taken along line K—K in FIG. 20.
Figure 21:
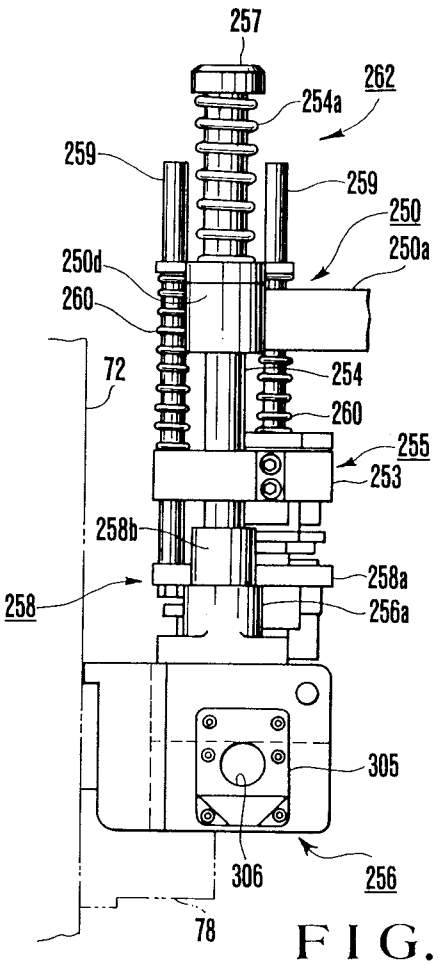
FIG. 21 is a side view as viewed in a direction of arrow J in FIG. 20.
Figure 23A:
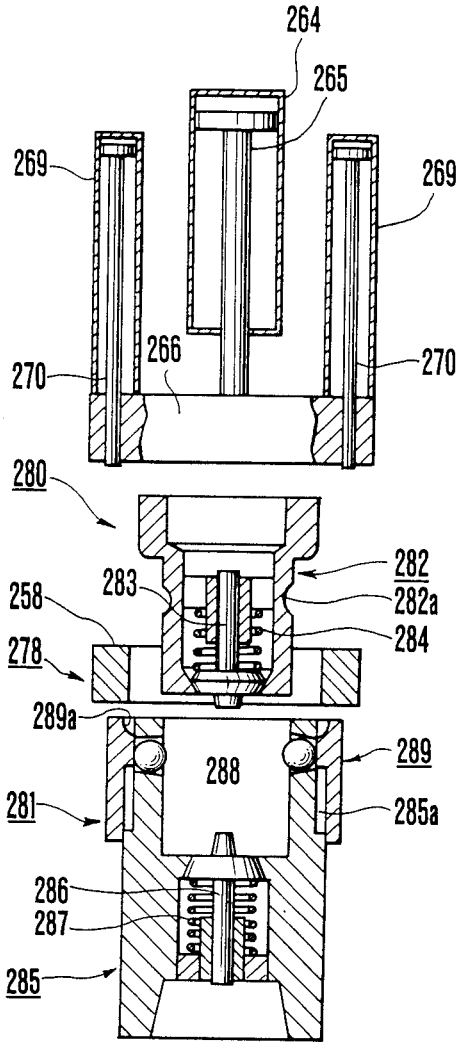
FIGS. 23A to 23D are explanatory views showing the operation of the automatic coupler mount and dismount device.
Figure 23B:
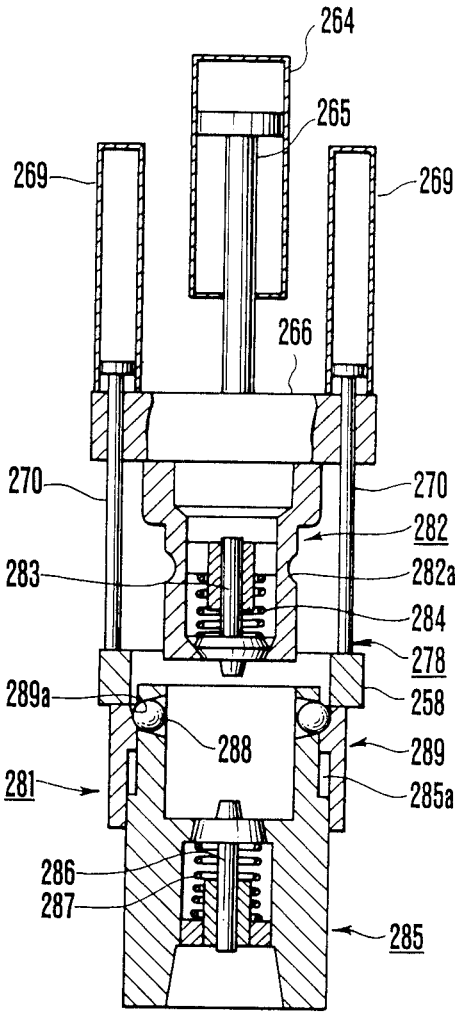
Figure 23C:
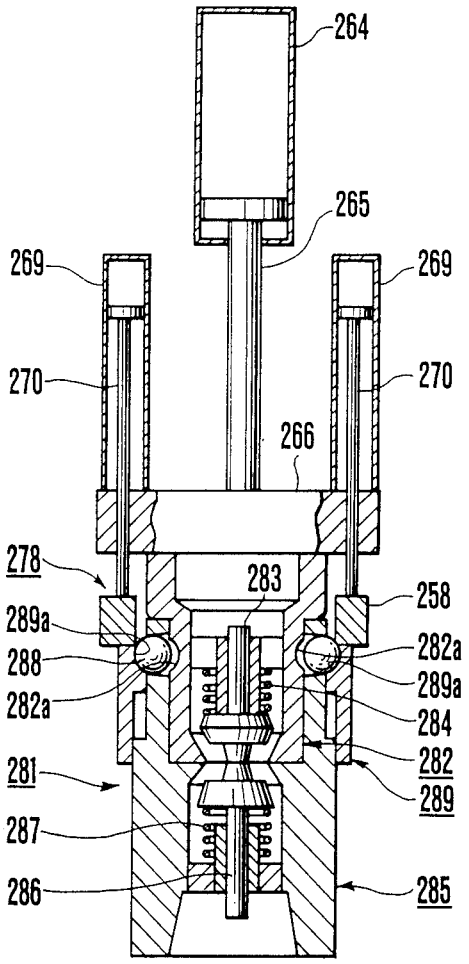
Figure 23D:
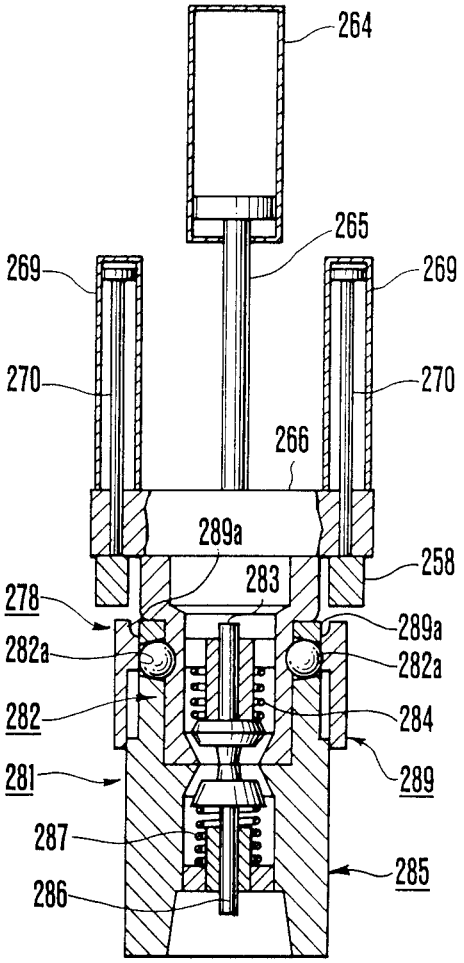

The coupling operation of the couplers 280 and 281 will now be described. In FIGS. 23A to 23D, indication of the frame 250, the rod 259 and the plug coupler 271 is omitted. It is illustrated that the male coupler 280 is directly pushed down by the pusher plate 266 of the main cylinder 264, and the pusher plate 258 is directly pushed down by the push rod 270 of the auxiliary cylinder 269. In the condition shown in FIG. 23A, the sleeve 289 is located at an upper position, the balls 288 are pushed inwardly by the lug on sleeve 289 and the upper and lower valves 283 and 286 are closed. Subsequently, the piston rod 264*a* of the main cylinder 264 lowers to begin pushing down the male coupler 280, and the push cylinders 270 of the auxiliary cylinders 269 lower to a great extent to push the push plate 258 as shown in FIG. 23B. The sleeve 289 is thus lowered by the push plate 258 so that the recesses 289*a* oppose the balls 288, whereby the balls 288 withdraw from the inner hole of the coupler body 285 and fit into the recesses 289*a*. Then, when the piston rod 264*a* of the main cylinder 264 continues to lower as shown in FIG. 23C, the male coupler body 282 is fitted into the inner hole of the female coupler body 285 to sit on a step portion. As a result, the valves 283 and 286 push toward each other in opposition to the resilient force of the valve springs 284 and 287, thus opening the upper and lower valve seats. In this instance, by upwardly moving the piston rod 270 of the auxiliary cylinder 269 to elevate the push plate 258, the sleeve 289 is prevented from being pressed. When the piston rod 270 of the auxiliary cylinder 269 is further elevated as shown in FIG. 23D, the sleeve 289 is allowed to rise, thereby pushing balls 288 into the recesses holes 282*a* from the recesses 289*a*, thus establishing coupling between both of the couplers 280 and 281 without slip-off. When the piston rod 264*a* of the main cylinder 264 is raised to the position shown in FIG. 23A, the coupling between the couplers 280 and 281 is completed. The coupling of the coupler 278 corresponding to the plug adapter 271 shown in FIG. 20 has been described. Simultaneously with this coupling, the coupler 279, corresponding to the other plug adapters 272 and 273, and a small coupler not shown are also coupled. Further, as shown in FIGS. 18 and 20, between the adapter mount plate 255 and the death plate 256, an electric connector 290 is removably mounted through a spacer 291 and a bracket 292. The connection of the electric connector 290 is established simultaneously with the coupling of the above-mentioned couplers 278 and 279.

Figure 1:
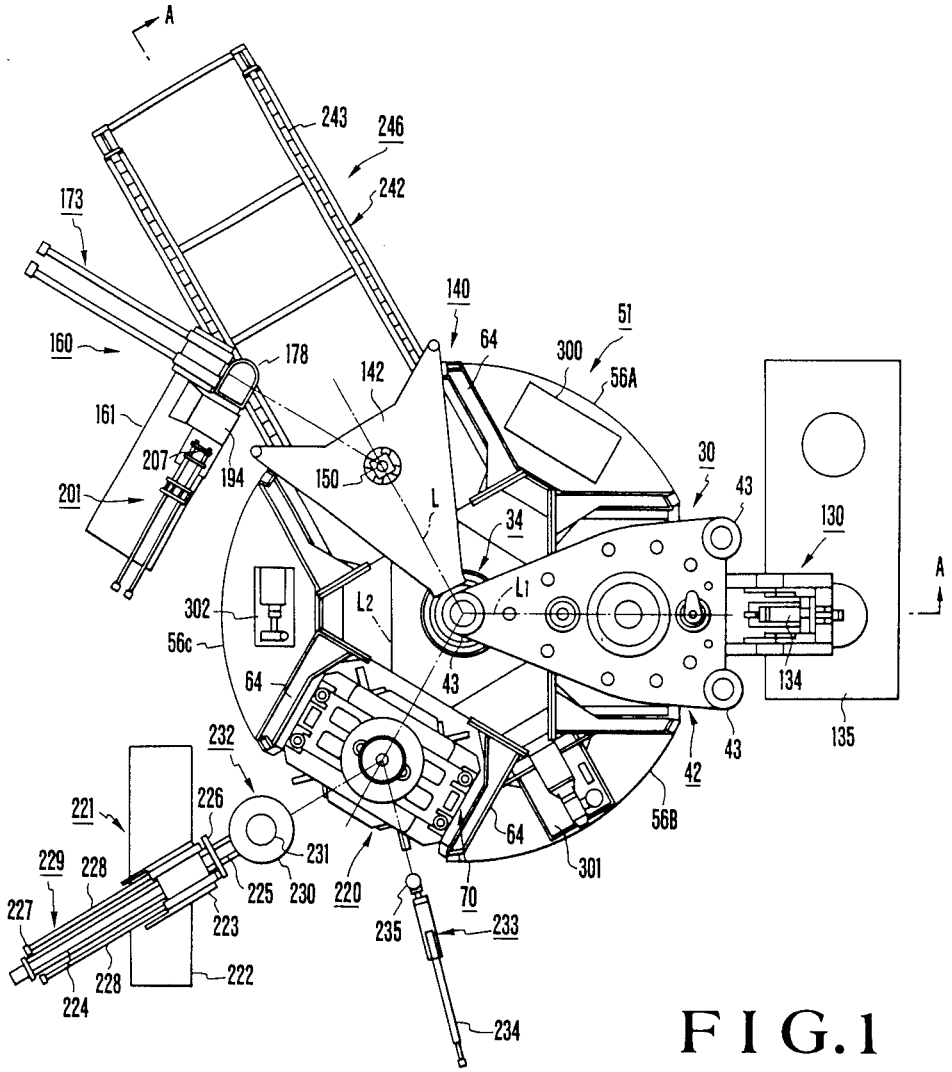
FIG. 1 is a plan view illustrating an embodiment of a die casting apparatus according to the present invention.
Figure 8:
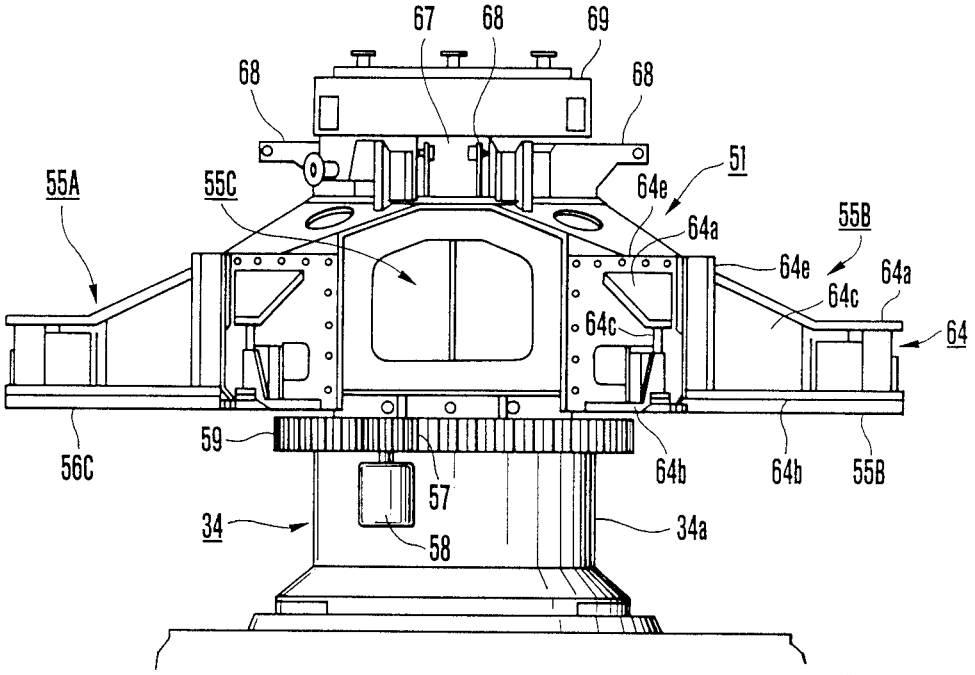
FIG. 8 is a front view as viewed in a direction of arrow E in FIG. 6.

As shown in FIG. 1, an electric control panel 300 is mounted on the supporting plate 65A of the rotary table 51 and connected to a power supply outside the apparatus through a rotary connection type connector. Further, an oil pressure power unit 301 with an oil tank electrically connected to the electric control panel 300, and a water pump 302 for cooling water, are mounted on supporting plates 56B and 56C respectively. In addition, the electric control panel 300 and the electric connector 290, provided on the die open and close unit holders 55A, 55B and 55C to oppose the arms 64, are connected together by lead wires. When the above-mentioned electric connector is automatically coupled, the limit switches of the die open and close unit 70 and the like are electrically connected to the power supply through the electric control panel 300 irrespective of the rotation of the rotary table 51. The male couplers 278 and 279 of different size are connected by means of hoses and the like to the oil pressure power unit 301, the water pump 302 for cooling water and the feed water chamber 451 shown in FIGS. 7 and 8. The female couplers 278 and 279 of different size are connected by means of hoses and the like to the die cooling device within the die open and close unit 70 and the die open and close cylinder 82. These hoses and the like pass through passages 304 provided in the death plate 256 of the adapters 276 and 277 and an inner hole 306 of a block 305 integral with the death plate 256. With the configuration thus connected, the cooling of the die of each die open and close unit 70 and the operation of the oil pressure device are performed irrespective of the rotation of the rotary table 51. When release of the coupling between the couplers 278 and 279 is required, an operation is conducted to activate the main cylinder 264 and the auxiliary cylinders 269 in the order of FIGS. 23D, 23C, 23B and 23A, thus making it possible to easily release the coupling by the action of the compression coil springs **254*a* and 260, the sleeve 289 and the balls 288**.

A die casting method with the die casting machine thus configured will now be described. Firstly, preparatory work is conducted by parallely placing the three sets of die open and close units 70, mounted with the metal molds 86 and 87, on the rollers 243 of the die preparation device 246. Next, the die open and close unit holder 55A, for example, is positioned at the second station 140 and the rotary table 51 is stopped. After the ram **65*b* of the push-up cylinder 65 provided at the arm 64 of the die open and close unit holder 55A is lowered, the motor 245 of the die preparation device 246 is operated to advance the die open and close unit 70 until it engages the stoppers 68 of the rotary table 51, whereby the die open and close unit 70 is stopped, by operation of the limit switches provided on the frame 240, at a predetermined position of the arm 64. There is no possibility that the advancing movement of the death plate 256 and the couplers 278 and 279 shown in FIG. 22 will be prevented, because the die open and close unit 70 advances at a lower position and the rods 254 and 259 are located at an upper position. When the ram 65*b* of the push-up cylinder 65 of the arm 64 rises to engage the ram hole 81 of the die open and close unit 70 so as to push it upwardly, the liner 79 is pushed up by the horizontal member 64*a*. As a result, so as to push the die open and close unit 70 upwardly, the liner 79 is pushed up by the horizontal member 64*a*. Consequently the die open and close unit 70 floats approximately 20 mm above the upper surface of the base plate 34. When the main cylinder 264 and the auxiliary cylinders 269 provided on the pusher frame 142 for automatic mounting and dismounting of the coupler are activated at the above-mentioned predetermined timing simultaneously with the fitting of the die open and close unit 70, the pusher plate 266 pushes the adapter mount plate 255 downwardly and the pusher plate 258 moves the sleeve 289 in a vertical direction. Thus, the female and male couplers 278 and 279 are coupled together and connection of the electric connector 290 is established. As a result, the die open and close unit 70 and the rotary table 51 are connected by the electric wiring, the feed water piping and the oil pressure piping. Subsequently, an operation is conducted to operate the die open and close cylinder 82 of the die open and close unit 70 to slightly push the movable metal mold 87 toward the stationary metal mold 86, thus applying a virtual or temporary die clamping force of a necessary minimum value to both of the metal molds 86 and 87**.

When the rotary table 51 is rotated counterclockwise through 120 degrees as in FIG. 1, the vacant die open and close unit holder **55*b* is positioned at the second station 140. Accordingly, the next die open and close unit 70 is fitted to the holder 55*b* in a manner similar to the above, thus coupling the couplers. During such fitting work, work at the first and third stations 30 and 220 is suspended. After the second die open and close unit 70 is fitted, the rotary table 51 is further rotated counterclockwise through 120 degrees and the next die open and close unit holder 55*c* is positioned at the second station 140. Accordingly, the third die open and close unit 70 is fitted thereto. Further, since the first die open and close unit 70 is then positioned at the first station 30, eventual or regular die clamping and injection are applied thereto. Specifically, when the main ram 103 is lowered under the application of oil pressure, the spacer 106 engages the upper surface of the top frame 76 to push the top frame 76 downwardly in opposition to oil pressure of the die open and close cylinder 82 and the push-up cylinder 65. Accordingly, after the die open and close unit 70 first seats on the upper surface of the metal mold contact surface 34*f* of the base platen 34, a large die clamping force (eventual or regular) acts on both of the metal molds 86 and 87, this mold clamping force being tolerated by the firm base platen 34. At this time, since the injection cylinder 9 is tilted in advance, the automatic hot molten metal feed device 130 feeds hot molten metal from within the melting furnace 135 into the injection sleeve 20, thereafter allowing the injection cylinder 9 to stand uprightly. Next, the ram 19 elevates the block 18 so as to fit the injection sleeve 20 into the stationary sleeve provided at the lower portion of the stationary metal mold 86 and to elevate the plunger 16 by actuation of the injection cylinder 9. The hot molten metal 136 within the injection sleeve 20 is thereby injected into the die cavity defined by the metal molds 86 and 87. When the hot molten metal 136 within the cavity is solidified to begin cooling, the moving platen 104 moves upwardly by removing pressurized oil from the main ram 103 and elevating the piston rod 109 of the pull-back cylinder 107, thus releasing the eventual or regular die clamping force. As a result, the metal molds 86 and 87 are mated together by the present virtual or temporary die clamping force of the necessary minimum value required for cooling only, such force being applied by the die open and close cylinder 82. Further, the die open and close unit 70 is pushed upwardly by the push-up cylinder 65 to float above the base platen 34. After injection, the injection cylinder 9**, returned to the lower position, is tilted to the position at which hot molten metal is poured.

While the cooling of the product within the die cavity is in progress, the die open and close cylinder is actuated and the rotary table 51 is rotated counterclockwise through 120 degrees. The second die open and close unit 70 is thereby positioned at the first station 30. Then, in a manner similar to the above, die clamping and injection are carried out. Further, the die open and close unit 70 is positioned at the second station 140 while in the process of cooling the product. Thus, cooling of the product continues until the die is opened. The term "in the process of cooling the product" mentioned above covers a time interval wherein, after hot molten metal is injected into the die cavity, the hot molten metal within the closed die cavity is being solidified and a resulting solidified injection product is being cooled; thereafter, the product is sufficiently cooled so that it may be taken out by opening the die.

Cooling time is important because individual injection products have different optimum cooling times (and cooling temperatures) depending upon various factors including the product's size and shape. If the die is opened and a product taken out too early, the product is not sufficiently solidified and has little strength, resulting in deformity of the product. In contrast, if the die is opened or the product taken out too late, the die is excessively cooled; as a result, the die is shrunk and the product is even more greatly shrunk. Also, where the product has portions which are removed from the die at a slower rate, the product partially sticks to the die. For instance, in the case of a product having two projecting portions spaced from each other, an H-shape or a channel-shape in cross section, for example, the product is greatly shrunk in relation to the die due to excessive cooling. As a result, the inner surface of the projecting portions adheres closely to the inner surface of the die. Further, when a product is excessively cooled, there is a possibility that it may bite, or cling to, the die, which would make it difficult or even impossible to remove the product from the die. Thus, excessive cooling does not make product take-out easier, and is unnecessarily time-consuming from an economic standpoint.

As stated above, the first die open and close unit 70 which has been subjected to injection at the first station 30 is rotated to shift to the second station 140 while in the process of cooling the product. Here, cooling of the product continues until the die is opened. Specifically, when the piston rod 83 of the die open and close cylinder 82 is moved upwardly to elevate the top frame 78 and at the same time the piston rod **149*c* of the projection cylinder 149 is elevated, the piston rod 149*c* passes through casting holes formed in the mount bed 71 of the die open and close unit 70 and the stationary metal mold 86 to push the biscuit portion of the casting product upwardly. The piston rod 149*c* rises until it reaches the position indicated by phantom line in FIG. 14. The product is thereby pushed up from the stationary metal mold 86 and the product held by the movable metal mold 87 rises along with the top frame 76. The saucer 178 of the device 160 for taking out the product is then advanced by the oil pressure cylinder 173 so as to be positioned below the opened movable metal mold 87. Then, when the piston rod 151 of the push cylinder 150 is lowered, the coupling 152 engages the boss 90*b* of the die open and close unit 70 and pushes the ejector plate 90 downward, thus extruding the product from the movable metal mold 87 through the pusher plate 96 and the pusher pins 97. The product is then received by the saucer 178. Subsequently, the piston rod 174 of the oil pressure cylinder 173 is withdrawn to withdraw the saucer 178 to the position shown in FIG. 17 and thereafter the piston rod 202 of the oil pressure cylinder 201 is withdrawn. Thus, by the advancing movement of the piston rod 202, the puller 207 is located in advance at the position indicated by phantom line in FIG. 17 and draws the product on the saucer 178 into the cage 194. Accordingly, when the piston rod of the oil pressure cylinder 187 is elevated, the cage 194 supported by the rollers 188 lowers while it is rotating to be immersed in the water tank 184, thus cooling the product. After cooling, the piston rod of the oil pressure cylinder 187 is lowered to return the cage 194 to the position shown. Thereafter, when the piston rod 202 of the oil pressure cylinder 201 is further withdrawn, the product on the cage 194 is raked out by the puller 207 and then discharged onto the shoot 208. The product slides on the shoot 208 and is eventually piled up on a receiving device. While the product is being taken out, the metal molds 86 and 87 are cooled by cooling water circulating through the water pump 302, the feed water chamber 451** and couplers.

When the rotary table 51 is rotated through 120 degrees counterclockwise in the process of cooling the metal molds 86 and 87, the injection for the second die open and close unit 70 is completed and this unit 70 is positioned at the second station 140. Further, the third die open and close unit 70 is positioned at the first station 30. Accordingly, die opening, product take-out, die clamping and injection are carried out for these die open and close units 70. In addition, since the first die open and close unit 70 is positioned at the third station 220, the preparatory operations such as cleaning the die, spraying mold release and mold mating are carried out at this station. Specifically, between the opened movable and stationary metal molds 87 and 86 of the die open and close unit 70 rotated to the third station 220, the spray head 232 of the die spraying device 221 is inserted by the oil pressure cylinder 224. Then, by using only air ejected from the upper and lower blocks 231, the upper and lower metal molds 87 and 86 are cleaned. Air and mold release are then both sprayed into the cavity defined by the upper and lower metal molds 87 and 86. If necessary, an insert is loaded into the cavity with the insert loading device 233. The molds are then mated together. Specifically, when the piston rod 83 of the die open and close cylinder 82 is lowered, the top frame 76 lowers, whereby the metal molds 86 and 87 are mated together and the virtual die clamping force of the predetermined necessary minimum value is exerted on the metal molds 86 and 87.

Figure 28A:
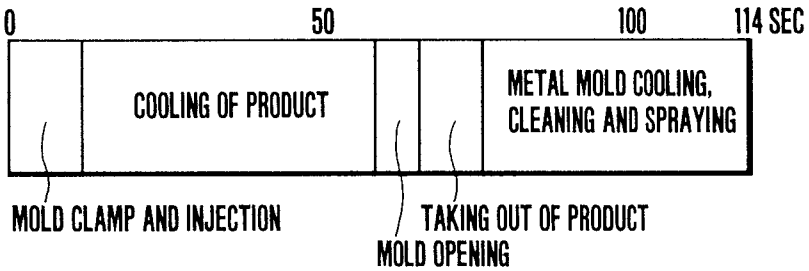
FIG. 28A PRIOR ART
FIG. 28A is an explanatory diagram of the times required for a casting cycle divided into processes when the conventional die casting machine shown in FIG. 27 is employed.
Figure 28B:
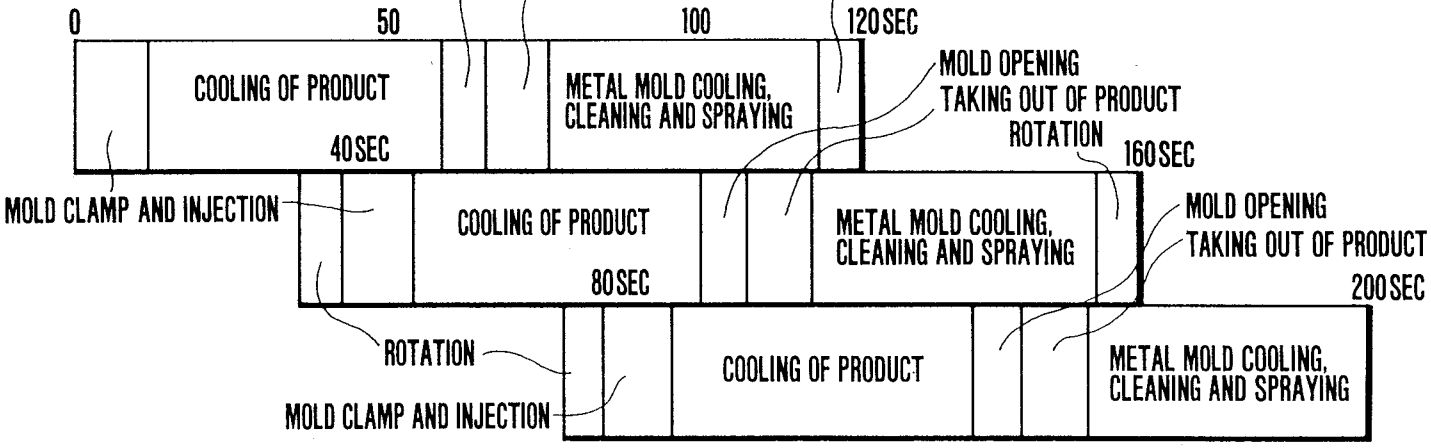
FIG. 28B PRIOR ART
FIG. 28B is an explanatory diagram of the times required for a casting cycle divided into processes when the die casting apparatus according to the present invention is employed.

Subsequently, when the rotary table 51 rotates twice through an angle of 120 degrees per each rotation, one casting process with the third die open and close unit 70 is completed. Thereafter, an ordinary casting cycle is executed again to cast a single product each time the rotary table 51 rotates through an angle of 120 degrees. Thus, when one rotation of the rotary table 51 is completed, three cast products are taken out. FIG. 28B is an explanatory view showing the time required for executing a casting cycle divided into processes according to the casting method of the present invention. When die clamping and injection are initiated for the first die and the rotary table is rotated in the process of cooling the product, one rotation can be performed within about 6 seconds. Accordingly, the die clamping of the second die can be initiated within about 40 seconds after the initiation of the die clamping of the first die followed by the above time of about 6 seconds. Similarly, the die clamping and injection for the third die are initiated after a delay of about 40 seconds. During the 40 seconds corresponding to the total time for die clamping, injection and rotation with respect to the first station 30, the work including rotation for the second and third stations is possible. Thus, the time required for one cycle from the beginning of die clamping for one die to the beginning of the next die clamping amounts to about 120 seconds. Accordingly, the time required for three products amounts to $120+40+40=200$ seconds. Thus, the average casting time for each product is about 67 seconds. Compared to the 114 seconds required employing the conventional casting method, productivity is greatly improved.

Where the die needs to be exchanged due to changes in the size of the product, such an exchange will be performed as follows. Firstly, three sets of die open and close units 70 to which new dies are mounted are placed in parallel on the rollers 243 of the die preparation device 246. It is assumed, for example, that the number of products to be cast by the dies now in use is 100. Then, when the die open and close unit 70 from which the 98th product is taken out is positioned at the third station after product take-out, spraying and like work are suspended for this die. Subsequently, when the rotary table 51 is rotated through 120 degrees so that the 98th die is positioned at the first station and the 99th die is positioned at the third station, die clamping, injection, spraying and the like are suspended for these dies. Further, when the rotary table 51 is rotated through 120 degrees so that the 99th die is positioned at the first station and the 100th die is positioned at the third station, die clamping, injection, spraying and like work are suspended for these dies. At this time, the 98th die has reached the second station and the die open and close unit mounted with this die is removed. For this removal, the ram **65*b* of the push-up cylinder 65 is lowered to allow this die open and close unit 70 to sit on the rollers 241 and at the same time the main cylinder 264 and the auxiliary cylinders 269 of the coupler automatic mount and dismount device are actuated in the order of FIGS. 23D, 23C, 23B and 23A. Consequently, the coupling between the couplers 278 and 279 and the electric connector 290 is released by the action of the compression springs 256 and 260, the sleeve 289 and the balls 288. Thus, when the motor 245 of the die preparation device 246 is rotated in the reverse direction, the rollers rotate in the reverse direction, whereby the die open and close unit 70 is returned onto the rollers 243. Subsequently, each time the rotary table 51 is rotated through 120 degrees, the die open and close unit 70 mounted with the 99th die and the die open and close unit 70 mounted with the 100th die are returned in this order to the outside of the apparatus. During this time period, work at the first and third stations is suspended. After the die open and close unit 70 mounted with the 100th die is removed, the rotary table 51 is rotated through 120 degrees. As a result, the vacant holder, which has been removed from the die open and close unit 70 mounted with the 98th die, is positioned at the second station. Accordingly, a first new die open and close unit 70 placed in advance on the rollers 243 of the die preparation device 246 is mounted to the holder of the rotary table 51 in accordance with the above-mentioned mounting method and the couplers are coupled together. When the rotary table 51 is rotated through 120 degrees, a second new die open and close unit 70 is mounted to the vacant holder which has been removed from the 99th die open and close unit 70 and the couplers are coupled together. Since the first new die open and close unit 70 is positioned at the third station, die opening, mold release spraying and mold mating are now performed with respect to this die open and close unit 70. When the rotary table 51 is further rotated through 120 degrees, the die having the molds mated together is positioned at the first station. Accordingly, eventual die clamping and injection is initiated for the first new die and at the same time, a third new die open and close unit 70 is mounted at the second station and die opening, mold release spraying and mold mating are performed for the second new unit 70 at the third station. Then, when the rotary table 51** is rotated twice by an angle of 120 degrees per each rotation, the third new die is positioned at the first station. Thereafter, the above-described ordinary casting cycle starts.

As stated above, when dies are to be exchanged, the removal of old dies and mounting of new dies can be carried out independently. There is therefore no need to stop the rotation of the rotary table 51 in order to perform the exchange work. In addition, at the initial and final stages of the exchange work, it is possible to continue the casting work with respect to the die other than the die to be exchanged or to initiate the casting work with respect to the new die. Thus, according to the method for die exchange employed in the present invention, serious loss of productivity can be prevented.

In the foregoing, it has been described for illustration purposes that when the die open and close unit 70 is exchanged at the second station, the work at the first and third stations is suspended. This is typically necessary in a case where three sets of dies are used for the same product and therefore the three sets of dies are all exchanged. However, where only one of three dies is exchanged for adjustment or maintenance, or where three dies are used for different products and one or two of these three dies must be exchanged, it is possible to continue ordinary casting with the die or dies other than those to be exchanged at the first station during exchange of the die open and close unit 70, thus ensuring that productivity can be maintained for the dies other than those to be exchanged.

According to the die casting method and apparatus stated above, the die open and close unit 70 for mounting the metal molds 86 and 87 is detachably mounted to the rotary table 51 and the die open and close cylinders 82 are provided for the die open and close unit 70. Accordingly, it is possible to virtually clamp the metal molds 86 and 87 by a virtual die clamping force of the necessary minimum value before and after eventual die clamping by the main ram 103 of the die clamping device 100, thus attaining the following advantages. In general, when die casting is implemented, a large die clamping force is required for the time period from initiation of injection to completion of solidification of hot molten metal. However, after the completion of the solidification, the necessity of die clamping gradually decreases with time. Accordingly, continuous exertion of the large mold clamping force over this time period results in a loss of energy. In this respect, the apparatus according to the present invention is configured to decrease the die clamping force as a function of the necessity thereof after solidification so that the virtual die clamping force is reduced to only the necessary minimum value required for the time for cooling during which the hot molten metal casted into the cavity is solidified, thus making it possible to reduce energy consumption to a great extent. With the die casting machine of the rotary table type as in the present invention, the rotary table can be rotated during the process of cooling products, thus shortening the molding cycle and greatly improving productivity.

In the foregoing embodiment, three work stations are provided but two, or more than four, work stations may be provided.

As appreciated from the foregoing description, in the die casting method and apparatus according to the present invention, a plurality of stations are provided and the table is rotated at least in the process of cooling products and during a time period from completion of preparation for die clamping to initiation of die clamping, thus effecting casting work. The rotary table of the apparatus has a plurality of holders on which die open and close units are detachably mounted, and has a die clamping device, injection device, device for taking out product and die spraying device which are arranged on a rotation path of the rotary table for sequential processings at respective stations, thus making it possible to simultaneously apply die clamping, injection work and other work to a plurality of dies. Accordingly, when compared to the conventional die casting method and apparatus of the stationary die type, the present invention can greatly shorten the casting cycle per product and remarkably improve productivity. Further, the present invention makes it possible to provide individual die open and close units with die open and close cylinders in addition to a die clamping cylinder to reduce the die clamping force after hot molten metal is solidified, thus greatly lessening the energy consumed by die clamping. In addition, the die open and close unit floats above the base platen when the rotary table mounted with the die open and close unit holding the die is rotated or when work except for eventual die clamping is carried out, and the die open and close unit is directly received by the base platen when eventual die clamping is carried out by strongly pushing the die within the die open and close unit by means of the die clamping cylinder, thus making it possible to perform eventual die clamping smoothly and exactly and perform rotation of the die open and close unit with ease.

A preferred second embodiment of the invention will now be described.

In the case of the first embodiment of the rotary die casting machine previously described, the rotary table retaining the die open and close unit mounted with the die always rotates. Consequently, when an attempt is made to circulate cooling water, the temperature of which is always kept low with respect to the die, it is difficult to connect a feed water source and a drainage pump (provided outside the apparatus or on the work station) to a feed water port and a drainage port of the die. With a view to solving this difficulty, a die cooling device according to the second embodiment is proposed. The die cooling device of this embodiment is efficiently applied to the rotary die casting machine of the first embodiment shown in FIG. 1.

On the upper end surface of the central cylindrical portion of the rotary table 51, an annular feed water conduit 451 which is rectangular in cross section is fixed. The feed water conduit 451 is integral with the rotary table 51 and rotatable along with the rotary table 51. The feed water conduit 451 has an upper annular opening 451*a*. Into the annular opening 451*a*, a feed water pipe 452 connected to a feed water source outside the apparatus is inserted so as to constantly feed cooling water. A cooling pipe 453 is led to the metal molds 86 and 87. On the supporting plate 56C of the rotary table 51, a cooling water pump 454 is mounted. An inlet and an outlet of the cooling water pump 454 are respectively connected to the bottom of the water feed conduit 451 via piping 455 and to the cooling piping 453 via piping 456. An annular drain conduit 457 which is rectangular in cross section is fixed to the bottom flange of the hollow shaft 50 serving as the non-rotating portion. The drain conduit 457 has an upper annular opening 457*a*. Inserted into the annular opening 457*a* are piping 458 connected to the exit of the cooling piping 453 and an overflow pipe 459 connected to the upper end portion of the feed water conduit 451. Further, connected to the bottom of the drain conduit 457 is a drain pipe 461 connected to a drainage pump 460. When both the pumps 454 and 460 are started, cooling water supplied from the feed water source to the feed water conduit 451 through the water feed pipe 452 circulates toward the drain conduit 457 via the pipings 455 and 456, the cooling piping 453 and the piping 458, thus cooling the metal molds 86 and 87. Water which has been used for cooling and drained into the drain conduit 457 is drained to the outside of the apparatus by the drainage pump 460. Further, when water within the water feed conduit 451 overflows, it is drained into the drain conduit 457 via the overflow pipe 459. The water within the drain conduit 457 is drained to the outside via the drain pipe 461. In this embodiment, a sensor 463 having a float 462 on top of the water surface within the drain conduit 457 is additionally provided. When the surface of the water within the drain conduit 457 exceeds a predetermined water level, the float 462 is rotated, causing the sensor 463 to actuate the drainage pump 460.

The casting operation of the second embodiment of the rotary die casting machine is the same as that of the first embodiment. However, after the injection of hot molten metal, the die cooling device of this second embodiment operates as follows. The cooling water pump 454 is rotating and the cooling water from the feed water source is fed to the feed water conduit 451 via the feed water pipe 452 to cool the metal molds 86 and 87 on its way to the drain conduit 457 via the pipings 455 and 456 and the cooling piping 453, thus solidifying and cooling the hot molten metal. When water within the drain conduit 457 reaches the predetermined amount, the float 462 rotates. As a result, the sensor 463 produces an electric signal which actuates the drainage pump 460. Thereafter, water is drained until water within the drain conduit 457 is below the predetermined amount. Consequently, the drainage pump 60 is intermittently operated depending upon the amount of water.

When the rotary table 51 is rotated through 120 degrees in the process of cooling the metal molds 86 and 87, the die open and close unit 70 holding the metal molds 86 and 87 in the process of cooling is positioned and stopped at the second station 140, followed by continuing cooling of the metal molds 86 and 87. In this instance, as cooling is in progress, the rotary table 51 rotates and the feed water conduit 451, the cooling water pump 454 and the pipings 455, 456 and 458 all rotate. However, because the feed water pipe 452 is inserted into the annular opening 451*a* and the drain pipe 458 is inserted into the annular opening 457*a*, the rotation of the rotary table 51 does not prevent the cooling of the metal molds 86 and 87.

After the cooling of the metal molds 86 and 87 is finished, the piston rod 83 of the die open and close cylinder 82 advances. Thus, simultaneously with the upward movement of the top plate 76, the piston rod of the projection cylinder advances. Accordingly, the product solidified and cooled is projected from the stationary metal mold 86 and rises while being held by the cavity of the movable metal mold 87 rising along with the top plate 76. When the upward movement of the top frame 76 is finished, the saucer 178 of the product take-out device 160 advances into the portion between the metal molds 86 and 87, and at the same time the piston rod of the push-up cylinder 150 advances to push the product downward. The product thus pushed out is received by the saucer 178. When the saucer which has received the product is withdrawn, the puller 207 which has been in a stand-by condition pulls the product to place it in the cage 194.

For cooling, the product held by the cage 194 is reciprocated by means of the link mechanism between the cooling water tank and the position at which the product is drawn out. The product thus cooled slides on the shoot and then is discharged and piled. As previously described, the opened metal molds 86 and 87 are then transferred toward the third station.

Thus, in accordance with the second embodiment of the die cooling device of the present invention, the feed water pipe provided for the non-rotating part is inserted into the annular opening of the feed water conduit to feed cooling water. After cooling the die, the water is drained into the drain conduit through the drain pipe inserted into the annular opening thereof. Accordingly, with this simplified construction, it is possible to freely rotate the rotary table during the process of cooling the die, thus enabling the realization of the rotary die casting machine at greatly improved productivity.

We claim:

1. A die casting apparatus comprising:

a plurality of dies comprised of metal molds;

means for injecting molten metal into said molds so as to form a product;

a plurality of die open and close units, each of said units holding one of said molds such that said molds may be opened and closed by said units and said units impart a temporary die clamping force to said closed molds;

a rotary table having, at circumferentially equidistant intervals, recesses for at least one of said units and holders for detachably holding said units in said recesses;

positioning means for aligning said units in a predetermined position within said recesses;

a plurality of work stations positioned on a locus of rotation of said units held in said recesses of said rotary table;

die clamping means disposed at one of said stations for imparting a regular clamping force to said molds, wherein said die clamping means is comprised of a base platen, against which one of said units abuts when said regular die clamping force is imparted, said base platen being spaced apart from said rotary table;

a push-up cylinder disposed between each of said units and said holder associated therewith, for floating said unit above said base platen when said regular die clamping is not effected; and means for removing said product from said molds.

2. A die casting apparatus as set forth in claim 1, wherein said positioning means comprises two parts, said first part having a tapered head and said second part having a head for receiving said tapered head.

3. A die casting apparatus as set forth in claim 1, wherein said die clamping means includes a moving platen provided opposite said base platen, said moving platen having a safety valve device for preventing said moving platen from being lowered accidently.

4. A die casting apparatus as set forth in claim 1, wherein the number of said work stations and said die open and close units is equal to three, a first work station being provided with said die clamping means and said injection means, a second work station being provided with said means for removing said product and a third work station being provided with means for conducting preparatory work on said molds.

5. A die casting apparatus as set forth in claim 1, which further comprises:

a die spraying device arranged within one of said work stations; and a first device for mounting and dismounting energy wiring and piping, said first device being interposed between said die open and close units and said rotary table and fitted and detached by a drive device on said work stations.

6. A die casting apparatus as set forth in claim 5, which further comprises an electric control panel, a power unit with a tank, and a cooling pump mounted on said rotary table and connected to said first device by means of wiring and piping.

7. A die casting apparatus as set forth in claim 1, wherein there is provided, at one of said work stations, a die mount and dismount station including a device for mounting and dismounting said die open and close units to and from said rotary table and a device for fitting and detaching energy wiring and piping between said rotary table and said die open and close units.

8. A die casting apparatus as set forth in claim 5, which further comprises a second device for mounting and dismounting said die open and close units, said second device being operative to advance and withdraw the die open and close unit between a die open and close unit holder of said rotary table stopped at said second device and said rotary table.

9. A die casting apparatus as set forth in claim 1, wherein said die open and close unit comprises a stationary member to which a stationary metal mold is fitted, said stationary member being retained by said rotary table, and a movable member to which a movable metal mold is fitted, said movable member being driven by a drive device to vertically move with said movable member being guided by a guide rod by making use of a guide hole in said stationary member, and said die casting apparatus further comprises a safety device for preventing said movable member from falling off, said safety device comprising a safety hook pivotable and supported on said stationary member so as to come in engagement with said guide rod when said movable member is located at an upper position, a spring member biasing said safety hook in an engaging direction of said guide rod, and drive means supported at a non-rotating part outside said rotary table to become operative at the time that die opening is initiated before die clamping to rotate said safety hook in a direction of releasing the engagement between said safety hook and said guide rod.

10. A die casting apparatus as set forth in claim 1, wherein said die open and close unit is comprised of a stationary member retaining a stationary metal mold and supported on said rotary table and a movable member retaining a movable metal mold sothat said movable metal mold comes in contact with said stationary metal mold or away therefrom, a product pusher device comprising a vertically movable plate of which upward movement is limited, said vertically movable plate being vertically movably supported on the upper end of said movable member, a first fluid pressure cylinder upwardly biasing said vertically movable plate with a part of said vertically movable plate being as a cylinder and with a part of said movable member being as a ram, a second fluid pressure cylinder fixed on said work stations to push said vertically movable plate downwardly at the die opening position of said movable member, and a product extruding pin fixed on said vertically movable plate to penetrate through pin holes formed in said movable member and said movable metal mold so as to project into the cavity of said movable metal mold or withdraw therefrom depending upon the vertical movement of said vertically movable plate.

11. A die casting apparatus as set forth in claim 1, wherein said means for taking out product comprises:

(a) a saucer reciprocating between a position at which the product is extruded from said pair of metal molds in an opened condition and a position outside said metal molds;

(b) a product pulling mechanism having a puller member reciprocating on a path across said position outside said metal molds to pull the product on said saucer when said puller member runs across said saucer along said path;

(c) a receptacle for cooling to accommodate the product released from said retaining puller member;

(d) a product cooling tank for pooling cooling water;

(e) a link mechanism holding said product cooling receptacle to effect a link movement so as to allow said product cooling receptacle to reciprocate between a position at which product is released by said puller member and the interior of said product cooling tank; and (f) product discharging means to discharge the product within said product cooling receptacle toward the outside of the apparatus after said product is cooled.

12. A die casting apparatus as set forth in claim 1, which is further comprised of metal mold cooling means comprised of:

(a) a feed water conduit fixed on said rotary table to rotate along therewith, said feed water conduit having an upper annular opening and being concentric with said rotary table, a feed water pipe communicating with a feed water source disposed on a non-rotating portion and inserted into said annular opening of said feed water conduit;

(b) a circulating piping fixed on said rotary table and having an intermediate cooling water pump, said circulating piping connecting the bottom portion of said feed water conduit to a cooling piping within said metal molds;

(c) a drain conduit fixed on said non-rotating portion, said drain conduit having an upper annular opening and being concentric with said rotary table, a drain pipe communicating with an exit of said cooling piping within said metal molds being inserted into said annular opening of said drain conduit; and (d) drainage means connected to said drain conduit.

13. A die casting apparatus as set forth in claim 12, wherein said drain conduit contains water with a varying water level, and said metal mold cooling means is further comprised of a sensor having a float responsive to said water level, said sensor being electrically connected to said drain means.

* * * * *